US006978543B2

(12) United States Patent
Sakamoto et al.

(10) Patent No.: US 6,978,543 B2
(45) Date of Patent: Dec. 27, 2005

(54) METHOD OF MANUFACTURING AN INK JET HEAD HAVING A PLURALITY OF NOZZLES

(75) Inventors: Yoshiaki Sakamoto, Kawasaki (JP); Shuji Koike, Tokyo (JP); Tomohisa Shingai, Kawasaki (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 141 days.

(21) Appl. No.: 10/634,840

(22) Filed: Aug. 6, 2003

(65) Prior Publication Data

US 2004/0025343 A1 Feb. 12, 2004

Related U.S. Application Data

(60) Division of application No. 10/163,617, filed on Jun. 7, 2002, which is a continuation-in-part of application No. PCT/JP99/06958, filed on Dec. 10, 1999, now Pat. No. 6,637,870.

(51) Int. Cl.[7] ..... B21D 53/76; B41J 2/045; G01D 15/00; G11B 5/127

(52) U.S. Cl. ..... 29/890.1; 29/830; 29/831; 29/832; 347/68; 216/27

(58) Field of Search ..... 29/890.1, 830, 29/831, 832; 347/71, 68–72; 216/27, 94

(56) References Cited

U.S. PATENT DOCUMENTS 4,733,447 A * 3/1988 Ageishi ..... 29/890.1
5,441,593 A * 8/1995 Baughman et al. ..... 216/27
5,752,303 A * 5/1998 Thiel ..... 29/25.35
5,808,644 A 9/1998 Imamura et al. ..... 347/93
5,896,149 A * 4/1999 Kitahara et al. ..... 347/70
6,347,862 B1 * 2/2002 Kanno et al. ..... 347/68

(Continued)

FOREIGN PATENT DOCUMENTS

EP 0734866 A2 10/1996

(Continued)

OTHER PUBLICATIONS

European Search Report dated Jan. 27, 2003.

*Primary Examiner*—A. Dexter Tugbang
*Assistant Examiner*—Tai Van Nguyen
(74) *Attorney, Agent, or Firm*—Armstrong, Kratz, Quintos, Hanson & Brooks, LLP

(57) ABSTRACT

A printer having a plurality of nozzles each for discharging ink supplied from an ink supply part (50) comprises a head main body (3) including a plurality of pressure chambers each provided for each of the nozzles and filled up with ink, a plurality of pressurizers each provided for each of the pressure chambers for pressurizing the pressure chamber to discharge the ink in the pressure chamber through the nozzle and ink supply passages for supplying the ink from the ink supply part (50) to the plurality of pressure chambers, and a joint section (8) protruded from the head main body (3) for joining the ink supply part (50) to the head main body (3). The head main body (3) is formed on a substrate, and the substrate is partially removed from the head main body (3) so that a common ink passage is formed in the substrate for making communications between the ink supply passages and ink supply ports (51) of the ink supply part (50) while the joint section (8) is formed as a residual portion of the substrate on the head main body (3). This improves the degree of integration of an ink jet head to achieve the size reduction of the ink jet head, and enhances the rigidity thereof.

3 Claims, 27 Drawing Sheets

U.S. PATENT DOCUMENTS

| | | | | |
|---|---|---|---|---|
| 2002/0149652 | A1 | 10/2002 | Sakamoto et al. | 347/68 |
| 2002/0154198 | A1 | 10/2002 | Sakamoto et al. | 347/70 |

FOREIGN PATENT DOCUMENTS

| | | |
|---|---|---|
| EP | 0867488 A1 | 9/1998 |
| JP | 2-143861 | 6/1990 |
| JP | 5-8387 | 1/1993 |
| JP | 7-329293 | 12/1995 |
| JP | 7-329297 | 12/1995 |
| JP | 9-226120 | 9/1997 |
| JP | 11-70649 | 3/1999 |
| JP | 2000-117990 | 4/2000 |

* cited by examiner

METHOD OF MANUFACTURING AN INK JET HEAD HAVING A PLURALITY OF NOZZLES

CROSS REFERENCE TO RELATED APPLICATION

This application is a divisional of U.S. Ser. No. 10/163,167 filed Jun. 7, 2002, now U.S. Pat. No. 6,637,870 which is a continuation of PCT/JP99/06958 filed Dec. 10, 1999.

TECHNICAL FIELD

The present invention relates to an ink jet head having a plurality of nozzles for discharging ink supplied from an ink supply part. For example, it relates to an ink jet head suitable for use in a print head of an ink jet printer, a manufacturing method therefor and a printer including the ink jet head.

BACKGROUND ART

An ink jet printer is of a type injecting ink droplets through the use of an ink jet head having a plurality of nozzles to discharge the ink droplets toward a recording medium such as printing paper for directly adhering them thereonto. For example, the printing to the printing paper is made in a manner that, in a state where the ink jet head is reciprocated in cross directions of the printing paper, the printing paper is conveyed in a direction perpendicular to the moving directions of the ink jet head.

FIG. 34 is an exploded perspective view showing an essential construction of a conventional ink jet head. As FIG. 34 shows, the conventional ink jet head is equipped with a head plate 310 having a plurality of (ten in FIG. 34) of ink discharging sections 312 made therein and is made to be connected to an ink tank 320.

The ink tank 320 holds ink internally and supplies the ink through an ink supply port 322 to the head plate 310.

Each of the ink discharging sections 312 made in the head plate 310 is equipped with a nozzle for discharging ink, and is provided with an ink pressure chamber to be filled up with ink for each nozzle and an ink pressurizer for pressurizing the ink within the pressure chamber, with ink droplets being discharged from each of the nozzle when each of the ink pressurizers pressurizes the ink pressure chamber.

Incidentally, for example, as this ink pressurizer, a bimorph laminated member is known which, is composed of a piezoelectric element such as piezo and a diaphragm.

In addition, a common ink passage, not shown, is formed in the interior of the head plate 310, and the ink discharging sections 312 communicate through ink supply passages (not shown) with this common ink passage in a branched configuration.

Still additionally, an ink supply port 313 is made in the head plate 310 and communicates with the common ink passage.

Yet additionally, the head plate 310 and the ink tank 320 are coupled to each other in a manner that an adhering portion 311 of the head plate 310 and an adhering portion 321 of the ink tank 320 are adhered to each other through an adhesive or the like, and at this time, an ink outlet 322 of the ink tank 320 and the ink supply port 313 of the head plate 310 communicate with each other.

With this construction, the ink held in the ink tank 320 is supplied through the ink outlet 322 and the ink supply port 313 to the common ink passage and further delivered from the common ink passage through each of the ink communicating passages to the pressure chamber of each of the ink discharging sections 312.

In each of the ink discharging sections 312, the ink is injected from the nozzle with the pressure chamber being pressurized by the ink pressurizer, thus accomplishing the printing to printing paper.

However, in such a conventional ink jet head, an adhesive or the like is applied to the adhering portion 311 of the head plate 310 and the adhering portion 321 of the ink tank 320 and they are joined to each other for the adhesion between the head plate 310 and the ink tank 320, and hence, there is a possibility that, at this adhesion, the adhesive is forced out from adhering portions 311 and 321 to interfere with the electrodes of the ink discharging section 312 to affect the operations thereof adversely.

Therefore, in manufacturing the ink jet head, there is a need to secure a sufficient distance (adhesion allowance) between the adhering portion 311 and the ink discharging section 312 on the head plate 310, which hinders the enhancement of integration of the head plate 310, thereby making it difficult to achieve the size reduction of the head plate 310, that is, the ink jet head (in its turn, the ink jet printer)

Moreover, the head plate 310 generally has a low rigidity, in particular, in a case in which the head plate 310 is composed of a laminated substrate using a thin-film piezo as a piezoelectric element, its thickness is as low as approximately 0.2 mm, and for this reason, a problem arises in that the head plate 310 is breakable, particularly, in the process of the adhesion of the ink tank 320 to the head plate 310 or other processes, so the handling thereof requires the great care.

The present invention has been developed in consideration of these problems, and it is therefore an object of the present invention to improve the degree of integration of the head main body through the use of a worked-out construction for achieving the size reduction of an ink jet head and the size reduction of a printer as well, and further to secure a sufficient rigidity of the head main body.

DISCLOSURE OF INVENTION

For this purpose, in accordance with the present invention, there is provided an ink jet head having a plurality of nozzles for discharging ink supplied from an ink supply part, characterized by comprising a head main body including a plurality of pressure chambers each provided for each of the nozzles and filled up with ink, a plurality of pressurizers each provided for each of the pressure chambers for pressurizing the pressure chamber to discharge the ink in the pressure chamber through the nozzle and ink supply passages for supplying the ink from the ink supply part to the plurality of pressure chambers, and a joint section formed on the head main body to protrude therefrom for joining the ink supply part to the head main body, with the head main body being formed on a substrate and the substrate is partially removed from the head main body to form, in the substrate, a communicating passage for making a communication between the ink supply passage and an ink supply port of the ink supply part, and the joint section being formed as a residual portion of the substrate on the head main body.

Furthermore, in accordance with the present invention, there is provided a method of manufacturing an ink jet head having a plurality of nozzles for discharging ink supplied from an ink supply part, characterized by comprising a step of forming, on a substrate, a head main body including a plurality of pressure chambers each provided for each of the nozzles and filled up with ink, a plurality of pressurizers each provided for each of the pressure chambers for pressurizing the pressure chamber to discharge the ink in the pressure chamber from the nozzle and ink supply passages for supplying the ink from an ink supply part to the plurality of pressure chambers, and a step of removing the substrate partially from the head main body to form, in the substrate, a communicating passage for making a communication between the ink supply passage and an ink supply port of the ink supply part and of forming the residual portion of the substrate on the head main body as a joint portion for joining the ink supply part to the ink main body.

Still furthermore, in accordance with the present invention, there is provided a printer equipped with an ink jet head having a plurality of nozzles for discharging ink supplied from an ink supply part, characterized by comprising a head main body including a plurality of pressure chambers each provided for each of the nozzles and filled up with ink, a plurality of pressurizers each provided for each of the pressure chambers for pressurizing the pressure chamber to discharge the ink in the pressure chamber from the nozzle and an ink supply passage for supplying the ink from the ink supply part to the plurality of pressure chambers, and a joint section formed on the head main body to protrude therefrom for joining the ink supply part to the head main body, with the head main body being formed on a substrate and the substrate is partially removed from the head main body to form, in the substrate, a communicating passage for making a communication between the ink supply passage and an ink supply port of the ink supply part, and the joint section being formed as a residual portion of the substrate on the head main body.

As advantages, this enables securing a sufficient rigidity of the head main body and the ink jet head as well, and eliminates the need for the direct connection of the ink supply port of the ink supply part to the head main body, and further, even in the case of adhering the ink supply part through an adhesive or the like to the head main body, eliminates the possibility of the forced-out adhesive sticking to the pressurizers of the head main body, which results in eliminating the need for the formation of an adhesion allowance on the head main body, enhancing the degree of integration, and achieving the size reduction of the ink jet head and the printer as well.

In addition, since the ink supply part is joined to the head main body through the use of a portion (residual portion) of the substrate used in the process of manufacturing the head main body, it is possible to manufacture the ink jet head easily and at a low cost to reduce the manufacturing cost.

Still additionally, since, even in a case in which the ink supply part is adhered to the head main body through the use of an adhesive or the like, there is no possibility of the forced-out adhesive being attached to the pressurizers and others of the head main body, not only the formation of an adhesion allowance on the head main body becomes unnecessary and the integration becomes improvable, but also the size reduction of the ink jet head becomes feasible.

Yet additionally, the pressurizer can be composed of a diaphragm constituting a portion of the pressure chamber and a piezoelectric element for pressurizing the pressure chamber by driving this diaphragm, which enables the certain construction of the pressurizers and the improvement of facilitation of manufacturing of the ink jet head.

Moreover, the substrate can be made of magnesium oxide, which permits certain and easy manufacturing of the head main body and reduces the manufacturing cost because of the improvement of facilitation of manufacturing of the ink jet head.

Still moreover, the substrate can be partially removed through photoetching treatment, which allows the certain and easy removal of the substrate, thus reducing the manufacturing cost because of the improvement of facilitation of manufacturing of the ink jet head.

BRIEF DESCRIPTION OF DRAWINGS

FIG. 19(*b*) is a perspective view showing a construction of a head main body of the ink jet head according to the third modification of the first embodiment of the present invention.

BEST MODE FOR CARRYING OUT THE INVENTION (A) Description of First Embodiment

An embodiment of the present invention will be described hereinbelow with reference to the drawings.

Figure 1:
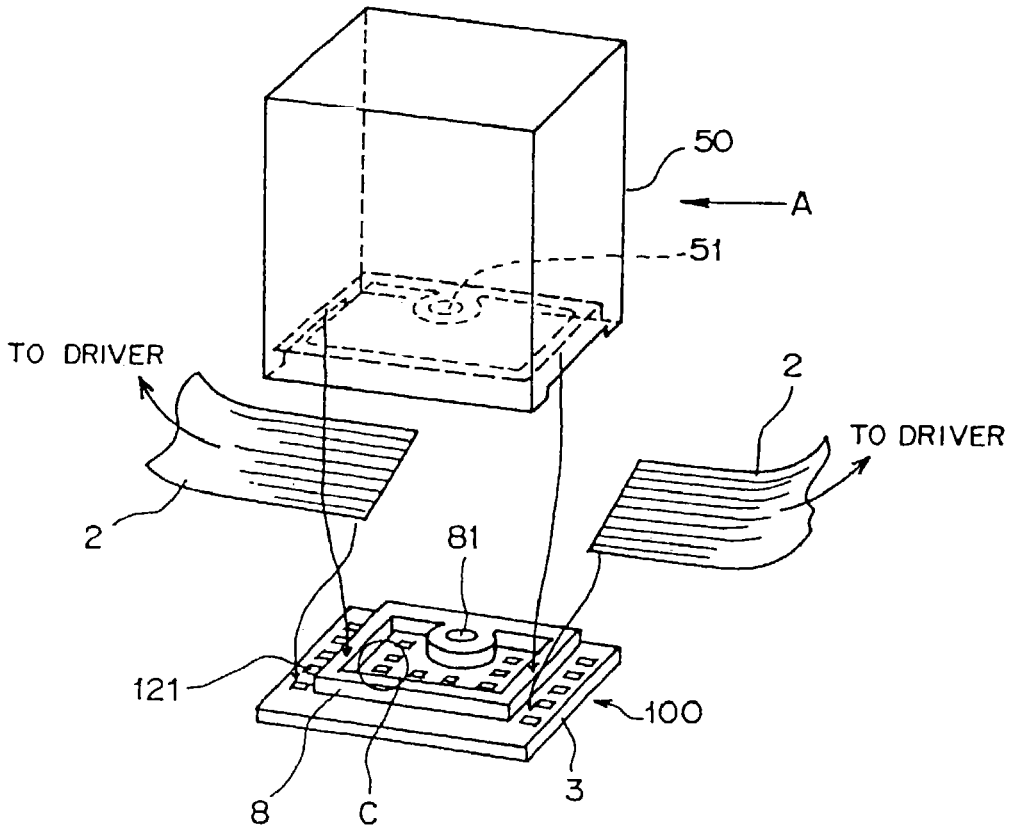
FIG. 1 is an exploded perspective view showing the entire construction of an ink jet head according to a first embodiment of the present invention.
Figure 2:
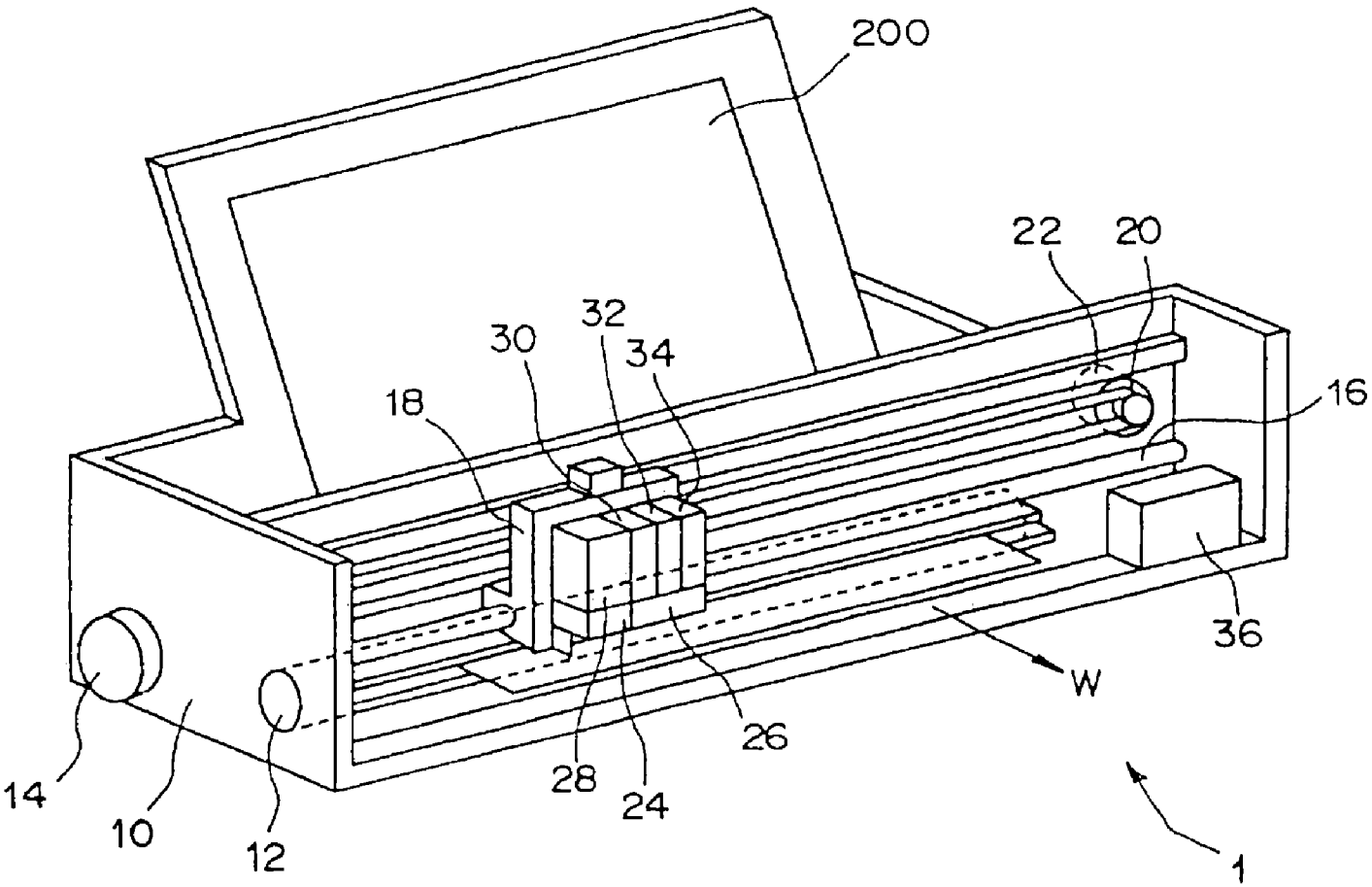
FIG. 2 is a perspective view showing a construction of an ink jet printer including this ink jet head.

FIG. 1 is an exploded perspective view showing the entire construction of an ink jet head according to a first embodiment of the present invention, and FIG. 2 is a perspective view showing a construction of an ink jet printer equipped with the ink jet head according to the first embodiment.

An ink jet printer 1 is of a type discharging ink toward printing paper 200 for forming an image on a surface thereof, and in the interior of a housing 10 thereof, there are placed a platen 12, a carriage 18, a nozzle maintaining mechanism 36, ink jet head units 24, 26 and ink tanks 28, 30, 32, 34.

The platen 12 is mounted on the housing 10 to be rotatable in a state perpendicular to the conveying direction of the printing paper 200 in this ink jet printer 1. Moreover, the platen 12 is made to be rotatably driven intermittently by a drive motor 14, thereby intermittently conveying the printing paper 200 at a predetermined feed pitch in a direction indicated by an arrow W in FIG. 2.

In addition, above the platen 12 within the housing 10, a guide rod 16 is located in a direction parallel with the platen 12, and the carriage 18 is mounted on this guide rod 16 to be slidable thereon.

This carriage 18 is attached to an endless drive belt 20 stretched in parallel with the guide rod 16, and this endless drive belt 20 is driven by a drive motor 22 so that the carriage 18 reciprocates along the platen 12. Moreover, the ink jet head units 24 and 26 are mounted on the carriage 18 to be detachable therefrom.

In the ink jet head units 24 and 26, the ink tanks 28, 30, 32 and 34 are connected to an ink jet head 100. In this case, in the ink jet head unit 24 the ink tank 28 is set which accommodates black ink, and in the ink jet head unit 26 the ink tanks 30, 32 and 34 are set which accommodate yellow ink, magenta ink and cyan ink, respectively.

While the carriage 18 reciprocates along the platen 12, the ink jet head units 24 and 26 are driven on the basis of image data given by a host unit, not shown, such as a personal computer so that predetermined characters, images or the like are printed on the printing paper 200.

At the stopping of printing, the carriage 18 (ink jet heads 24 and 26) is shifted to a position (home position) where the nozzle maintaining mechanism 36 exists.

The nozzle maintaining mechanism 36 is composed of a movable suction cap (not shown) and a suction pump (not shown) coupled to this movable suction cap, and when the ink jet head units 24 and 26 are shifted to the home position, the suction cap is suction-attached to a nozzle plate (which will be mentioned later) in each of the ink jet head units 24 and 26, and when the suction pump is driven, the nozzles of each of the nozzle plates are sucked to prevent the clogging of the nozzles.

Referring to FIGS. 1 and 3 to 7, a description will be given hereinbelow of a construction of the ink jet head 100 according to the first embodiment of the present invention.

Figure 3:
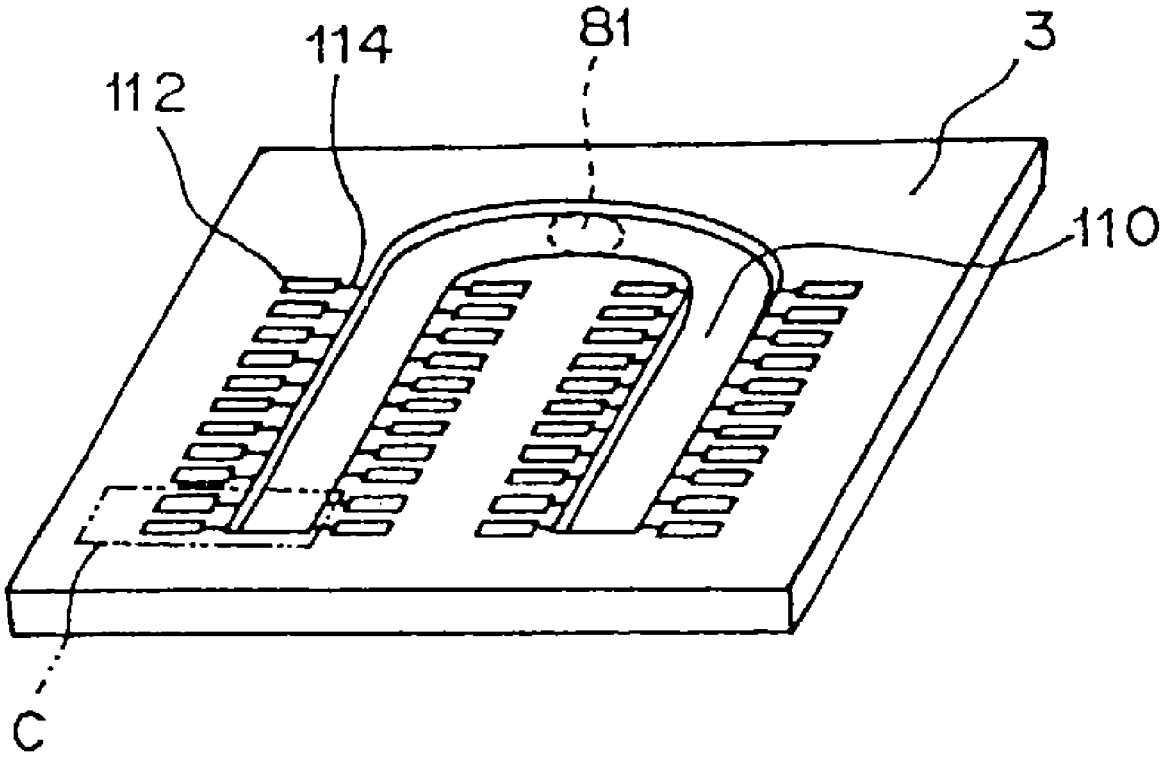
FIG. 3 is a perspective view showing a horizontal cross section of a head main body in FIG. 1 for explaining a construction of the head main body of the ink jet head according to the first embodiment.
Figure 4:
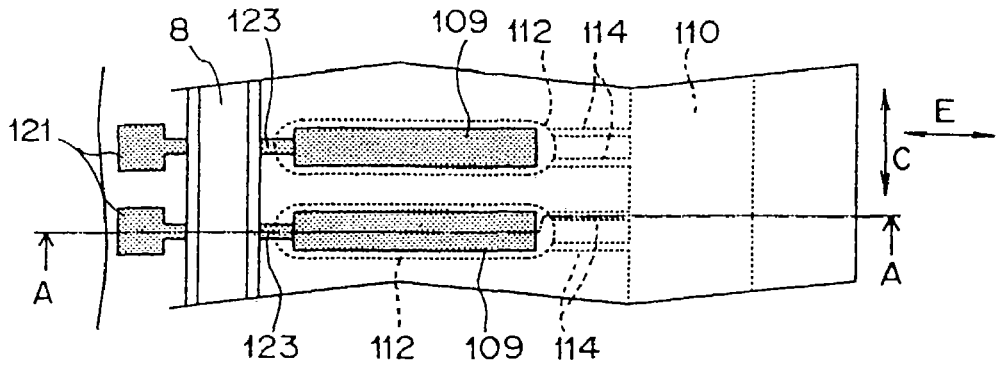
FIG. 4 is an enlarged plan view showing a portion C of FIG. 1.
Figure 5:
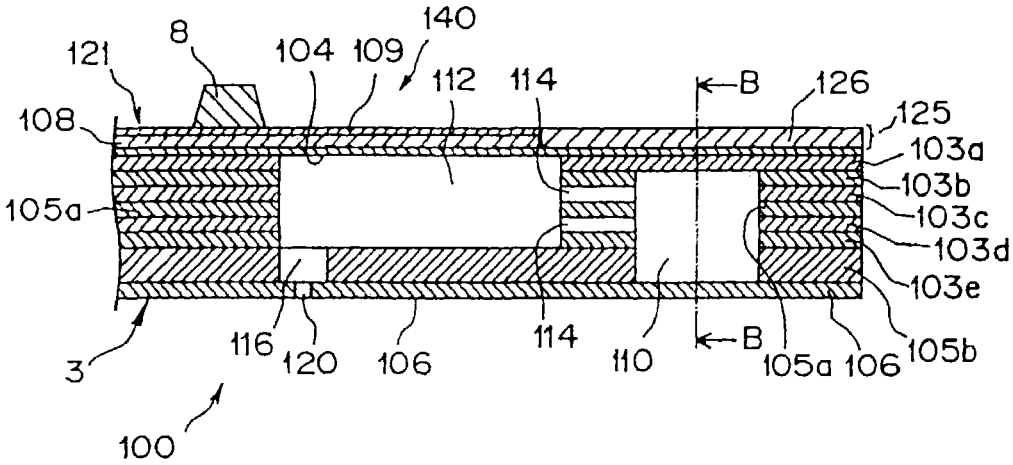
FIG. 5 is a cross-sectional view taken along, A—A indicated by arrows in FIG. 4.
Figure 6:
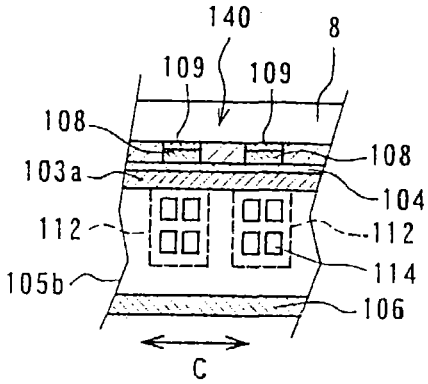
FIG. 6 is a cross-sectional view taken along B—B indicated by arrows in FIG. 5.
Figure 7:
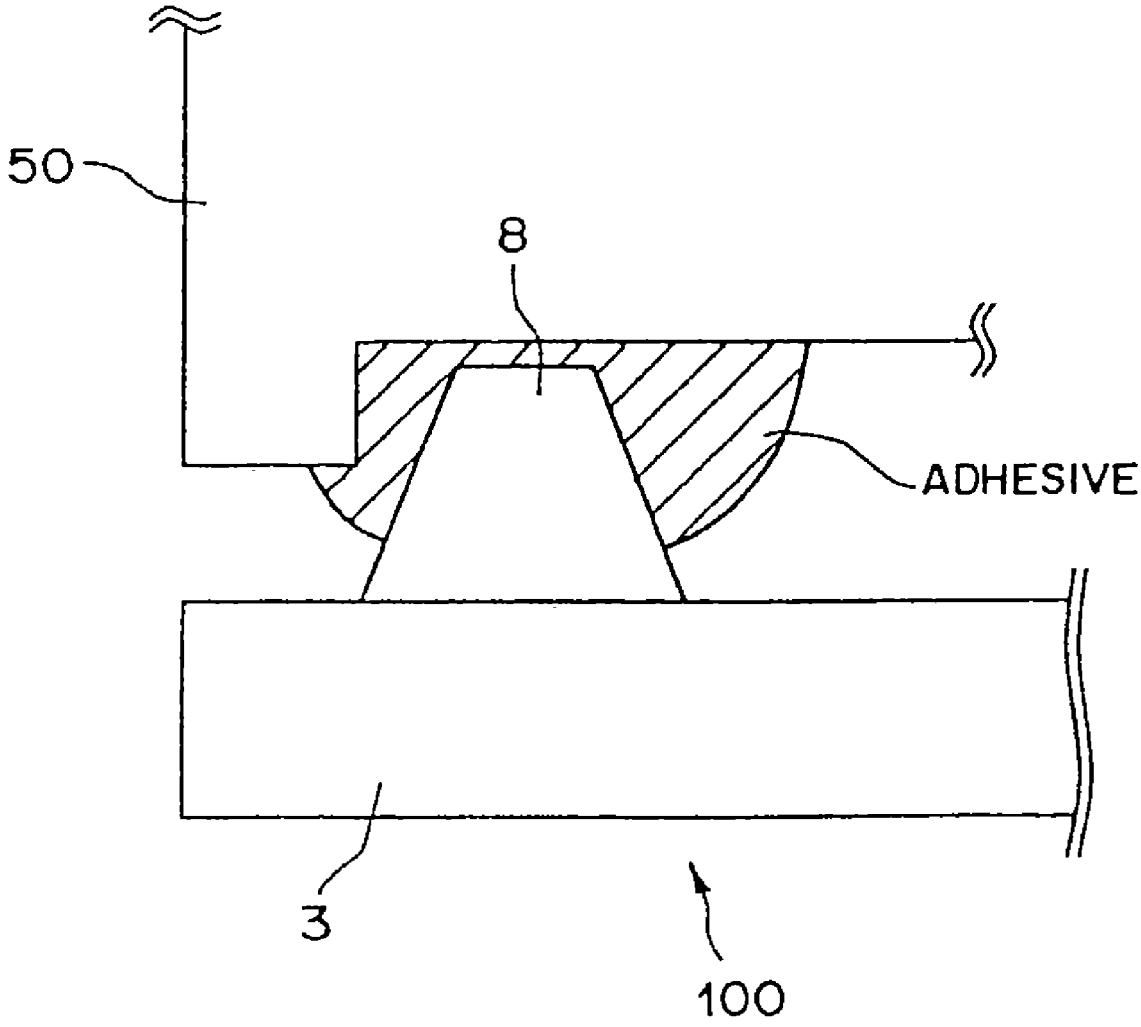
FIG. 7 is a cross-sectional view showing a joint portion of the ink jet head according to the first embodiment of the present invention.

FIG. 3 is a perspective view showing a horizontal cross section of a head main body in FIG. 1 for explaining an internal construction of the head main body of an ink jet head according to the first embodiment, FIG. 4 is an enlarged plan view showing a portion C of FIG. 1, FIG. 5 is a cross-sectional view taken along A—A indicated by arrows in FIG. 4, FIG. 6 is a cross-sectional view taken along B—B indicated by arrows in FIG. 5, and FIG. 7 is a cross-sectional view showing a joint portion thereof.

The ink jet head 100 according to the first embodiment has a plurality of nozzles 120 (see FIG. 5) for discharging ink supplied from an ink tank (ink supply section) 50, and is made up of a head main body 3 and a joint section 8 as shown in FIG. 1.

As FIGS. 4 to 6 shows, the head main body 3 internally includes a common ink passage 110, and each of the plurality of nozzles 120 has a pressure chamber 112, a pressurizer 140 and ink supply passages 114.

As FIG. 5 shows, the head main body 3 of the ink jet head 100 according to the first embodiment is made by piling up a plurality of layers such as dry film resists 103*a* to 103*e*, a diaphragm 104, stainless plates 105*a*, 105*b*, a polyimide 126, discrete electrodes 109 and a nozzle plate 106. A manufacturing method based on this lamination will be described later.

The pressure chamber 112 is made to be filled up with ink, and communicate through a connecting passage 116 with the nozzle 120.

The pressurizer 140 is for pressurizing the pressure chamber 112 to discharge the ink in the pressure chamber 112 from the nozzle 120, and is composed of the diaphragm 104 and a piezoelectric element 108.

The diaphragm 104 is made with an elastically deformable metal thin-film (a thickness of approximately several $\mu$m), such as chromium or nickel, having an electrical conductive property and some degree of rigidity, and constitutes a surface which is in opposed relation to a portion of the pressure chamber 112, concretely, a surface of the pressure chamber 112 where the connecting passage 116 exists.

A thin-film-like piezoelectric element 108 is formed on a surface of the diaphragm 104 which lies on the opposite side to the, pressure chamber 112. This piezoelectric element 108 is made of a piezo ceramic or the like, and these diaphragm 104 and piezoelectric element 108 constitute a bimorph laminated member.

In addition, the discrete electrode 109 is formed on a surface of the piezoelectric element 108 which lies on the opposite side to the diaphragm 104, and drive signals are fed from drive circuits, not shown, to the diaphragm 104 and the discrete electrode 109 so that, in the pressurizer 140, the piezoelectric element 108 is deformed to pressurize the pressure chamber 112. That is, the discrete electrode 109 is provided for each of the pressure chambers 112 for driving each of the pressurizers 140.

The ink supply passages 114 are for supplying ink from the ink tank 50 to the pressure chamber 112 and further for making a communication between the common ink passage 110, which will be mentioned later, and the pressure chamber 112, and in the first embodiment, they are four in number for each of the pressure chambers 112.

Incidentally, limitation is not imposed on the number of ink supply passages 114 and the locations thereof, but all changes which do not constitute departures from the spirit and scope of the invention are acceptable.

As FIG. 3 shows, the common ink passage 110 is made into a U-like space configuration in the interior of the head main body 3, and the substantially central position thereof is made to communicate with a communicating passage 81. Moreover, this common ink passage 110 is made to communicate with the ink supply passages 114 and an ink supply port 51 of the ink tank 50.

In addition, in the common ink passage 110 and the ink supply passages 114, the flow resistance of the ink is adjusted to absorb the abrupt fluctuation of the internal pressure in each of the pressure chambers 112, and after the pressure chamber 112 is contraction-pressurized to discharge the ink, at the return, a necessary amount of ink is made to be supplied through the ink supply passage 114 to the pressure chamber 112. Incidentally, this ink supply is also done under the adjustment of the flow resistance.

Still additionally, the plurality of pressure chambers 112 are located in a branched condition with respect to the common ink passage 110, and these pressure chambers 112 and common ink passage 110 are made to communicate through the above-mentioned ink supply passages 114 with each other.

The pressure chambers 112 are arranged in order in a direction indicated by an arrow C in FIGS. 4 and 6.

As FIG. 1 shows, the joint section 8 is formed protrusively in a surface on the opposite side (on the side of the formation of the discrete electrodes 109 in the head main body 3) to the formation of the nozzles 120 in the head main body 3, and is made to surround the discrete electrodes 109 on the surface of the head main body 3 where the discrete electrodes 109 exist.

That is, the joint section 8 is made to surround the discrete electrodes 109 on the surface holding the discrete electrodes 109, contact portions (which will be mentioned later) and a wiring pattern (which will be mentioned later).

As will be described later, for the formation of this joint section 8, a substrate made of magnesium oxide (MgO) is partially removed from the head main body 3 by means of photoetching, thereby forming the joint section 8 as a residual portion of the substrate on the head main body 3. Moreover, as FIG. 7 shows, the ink tank (ink supply part) 50 is adhered through as adhesive or the like to the joint section 8, thereby joining the ink tank 50 (ink tank fixing member) to the head main body 3.

Incidentally, the joining to the joint section 8 is not limited to the above-mentioned ink tank 50, but it can be made with respect to, for example, a member (ink tank fixing member; not shown) which is capable of holding the ink tank 50 detachably.

In addition, as FIGS. 5 and 7 show, this joint section 8 has a cross-sectional configuration, tapered to be narrower at the top, whereby an adhesive forced out from an adhering surface to the ink tank 50 or the like is held by its slopes to prevent the forced-out adhesive from reaching the head main body 3.

On the surface of the head main body 3 where the discrete electrodes 109 exist, a plurality of contact portions 121 are formed in the vicinity of an outer-edge portion of the head main body 3, concretely, outside the joint section 8.

Each of these contact portions 121 is formed with respect to each of the discrete electrodes 109, and these contact portion 121 and the discrete electrode 109 are electrically connected to each other through a wiring pattern 123 formed with a thin film.

Moreover, these contact portions 121 are electrically connected to FPCs (Flexible Printed Circuit Boards: external connection wiring members) 2, which supplies signals for the control of the pressurizers 140, through the use of a TAB (Tape Automated Bonding) manner.

A polyimide 126 is placed in an area on the diaphragm 104, where the piezoelectric element 108 and the discrete electrode 109 are absent, for the electrical insulation.

Secondly, referring to FIGS. 8 to 10, a description will be given of a configuration of the wiring pattern 123 which makes the electrical connection between the each of the discrete electrodes 109 and each of the contact portions 121.

Figure 8:
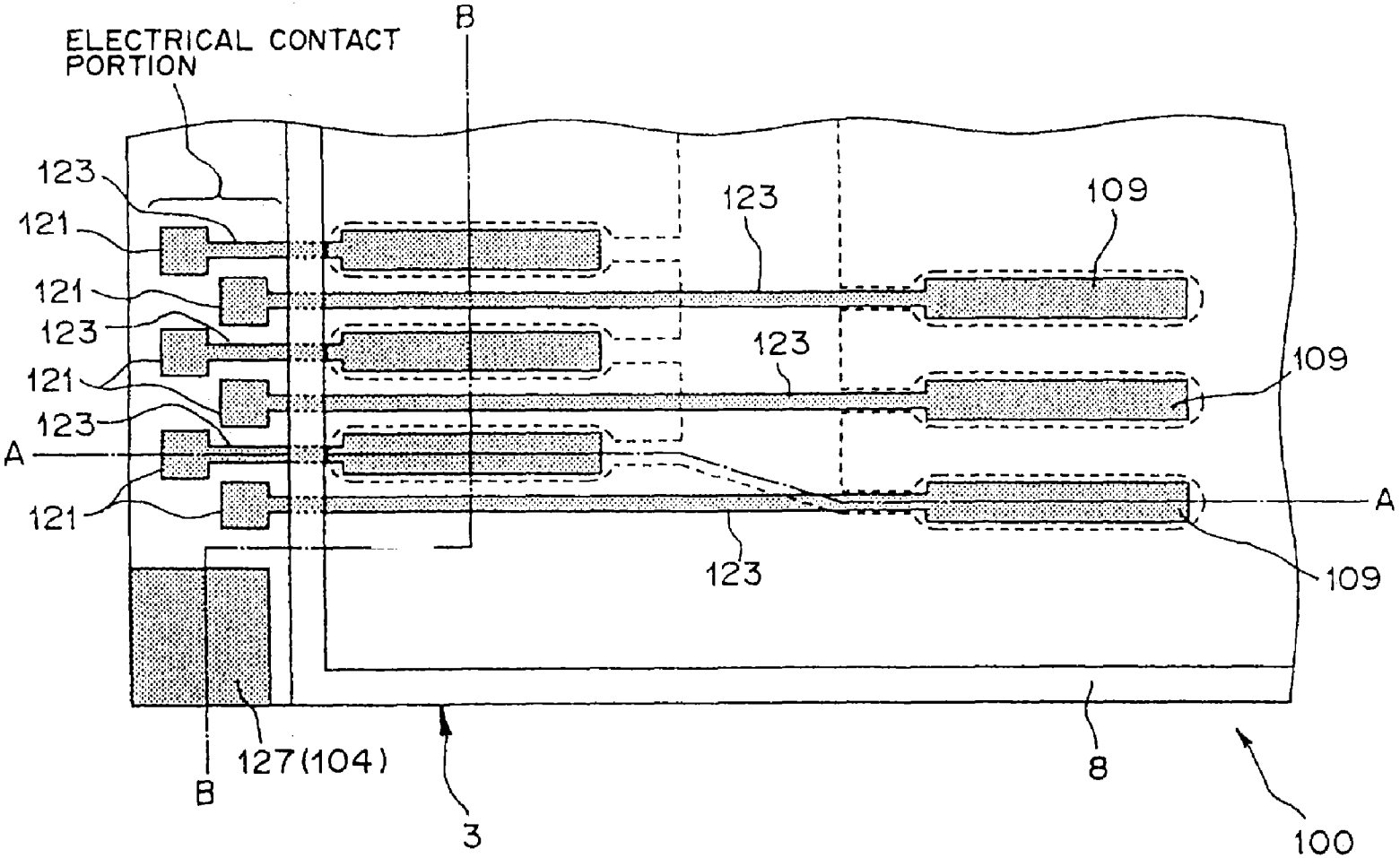
FIG. 8 is an enlarged plan view showing an essential part of a wiring pattern of the ink jet head according to the first embodiment of the present invention.
Figure 9:
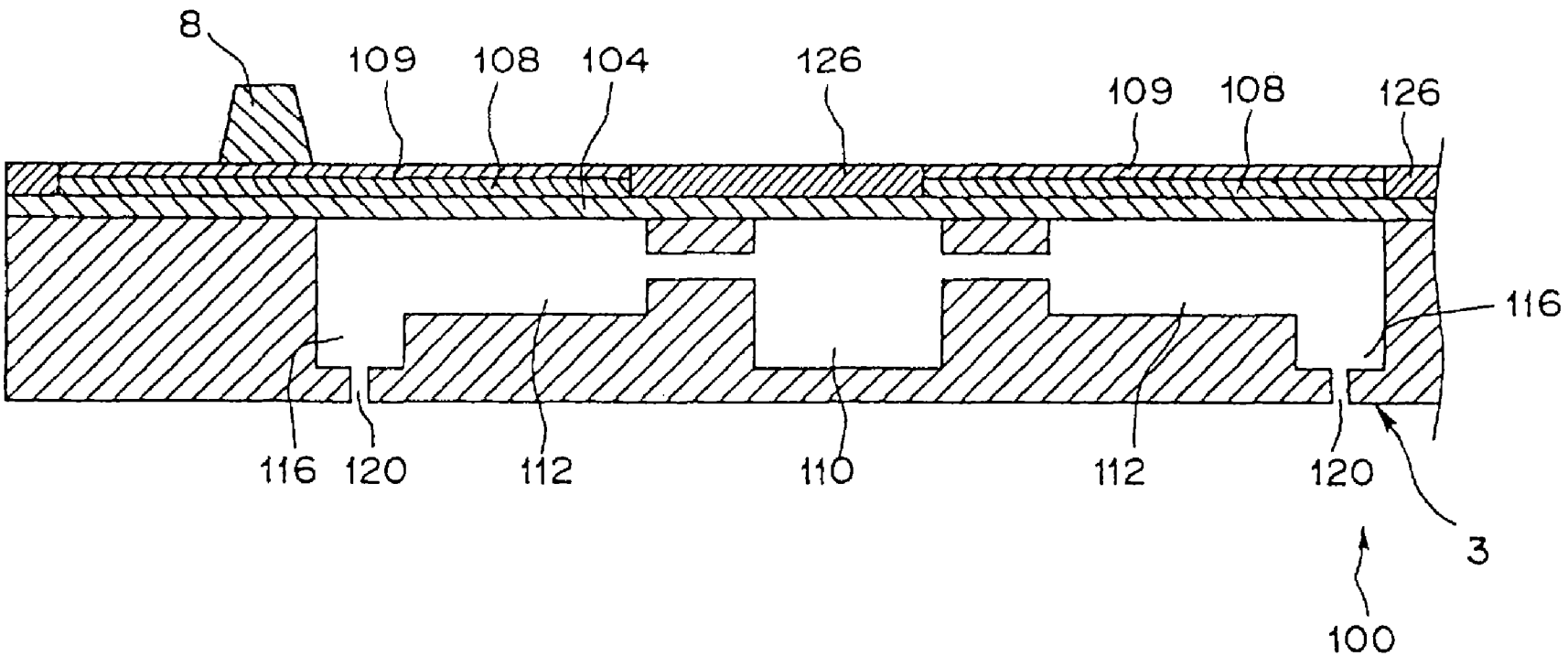
FIG. 9 is a cross-sectional view taken along a line A—A of FIG. 8.
Figure 10:
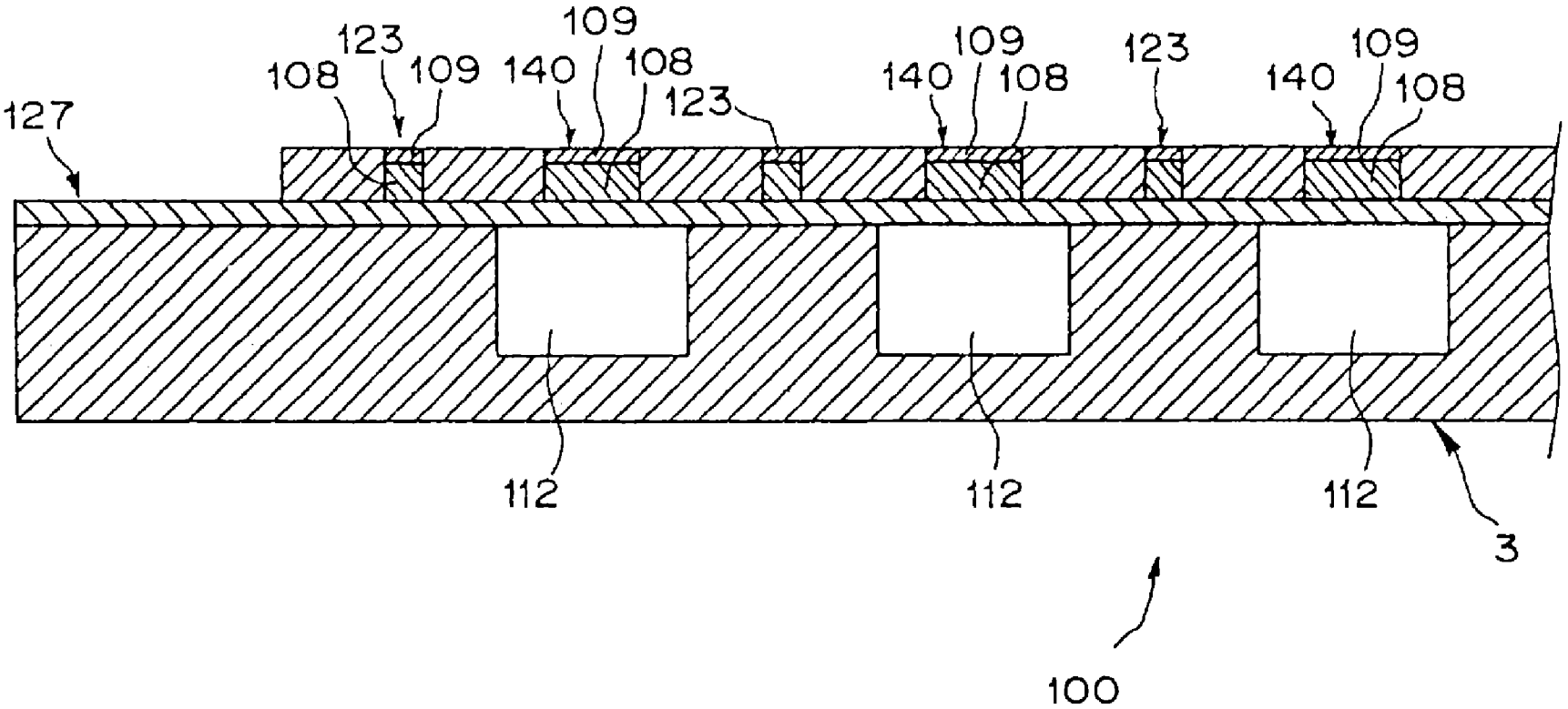
FIG. 10 is a cross-sectional view taken along a line B—B of FIG. 8.

FIGS. 8 to 10 are illustrations for explaining a configuration of the wiring pattern 123. Of these, FIG. 8 is an enlarged plan view showing an essential part of a wiring pattern of the ink jet head according to the first embodiment of the present invention, FIG. 9 is a cross-sectional view taken along a line A—A of FIG. 8, and FIG. 10 is a cross-sectional view taken along a line B—B of FIG. 8.

In FIGS. 9 and 10, the laminated structure comprising the dry film resists 103*a* to 103*e* and the stainless plates 105*a* and 105*b* is omitted for convenience only.

As FIG. 8 shows, each of the contact portions 121 is formed outside the joint section 8 (on the circumferential edge side) on the surface of the head main body 3 where the discrete electrode 109 and others exists, and the contact portion 121 and the discrete electrode 109 are electrically connected to each other through the wiring pattern 123.

As will be mentioned later, the wiring pattern 123, together with the discrete electrode 109 and the contact portion 121, is formed on the head main body 3 by means of patterning, and therefore, they are integrally made from the same material on the same plane in the form of a thin film.

In addition, as FIGS. 8 to 10, each of the wiring patterns 123 is laid in parallel with the longitudinal direction (left-right direction in FIG. 8) of each of the discrete electrodes 109 to pass between the discrete electrodes 109 (pressure chambers 112), and as FIG. 9 shows, each of the wiring patterns 123 is located below the joint section 8, that is, located to pass between the head main body 3 and the joint section 8.

Still additionally, as FIG. 8 shows, in the head main body 3, on the surface of the side of the formation of the discrete electrode 109 and others, the diaphragm 104 appears outside the joint section 8 and in the vicinity of a corner portion of the head main body 3, thereby forming the contact portion 127.

Moreover, the FPCs 2 are electrically connected to these contact portions 121 and 127 by means of the TAB or the like so that, as shown in FIG. 7, even in a case in which the ink tank 50 (ink tank fixing member) is joined to the joint portion 8, without receiving the influence thereof, the discrete electrode 109 and the diaphragm 104 can be electrically connected to the FPC 2 for supplying a signal for the control of the pressurizer 140.

Although the contact portion 127 is made to be lower than the other contact portions 121 by a thickness corresponding to the piezoelectric element 108 and the discrete electrode 109, since, for example, the thickness of the piezoelectric device 108 is as sufficiently low as approximately 2 to 3 $\mu$m and the thickness of the discrete electrode 109 is as sufficiently low as approximately 0.2 $\mu$m, the influence on the pressing connection of the FPC 2 or the like does not occur.

Figure 13:
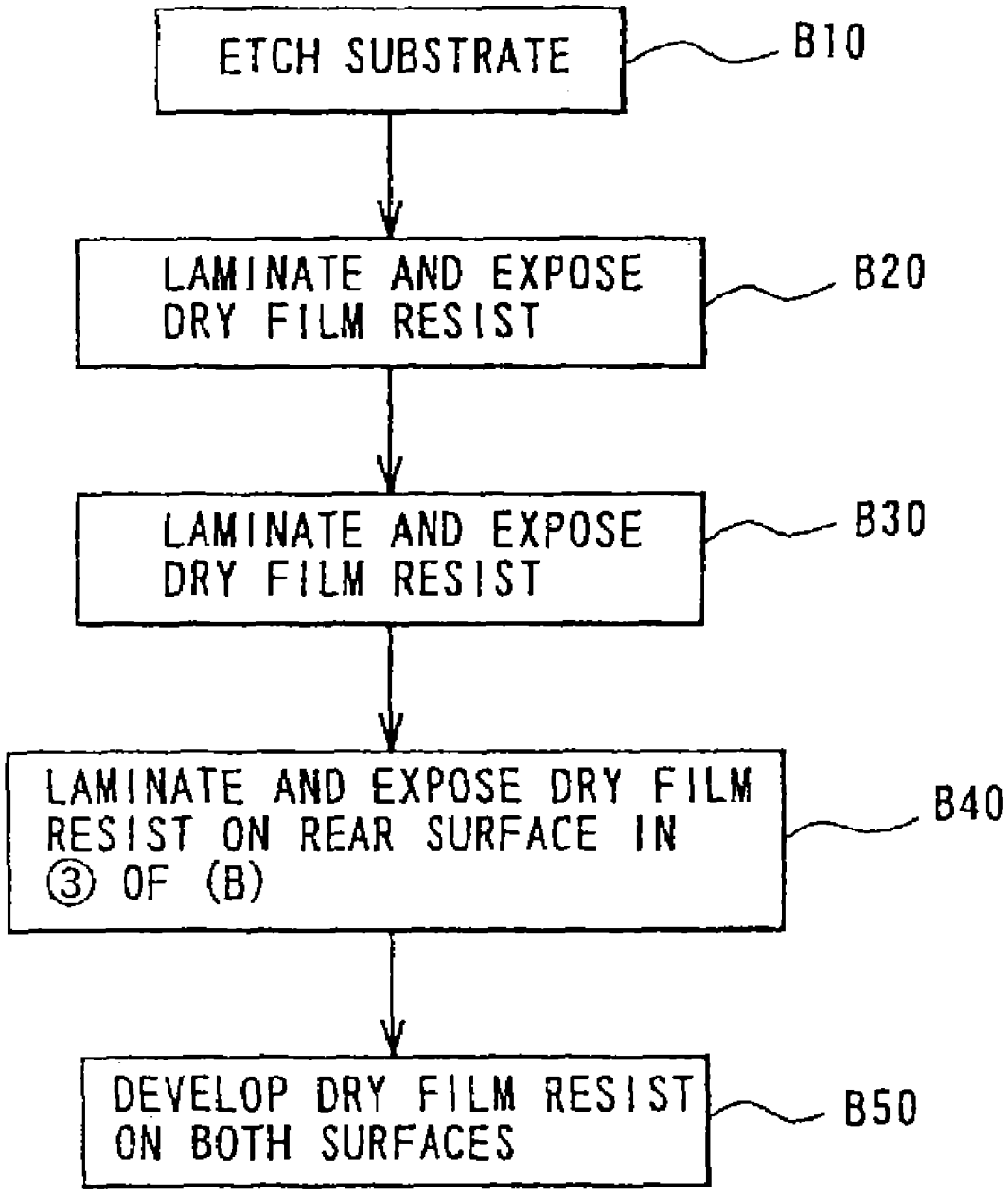
Figure 14:
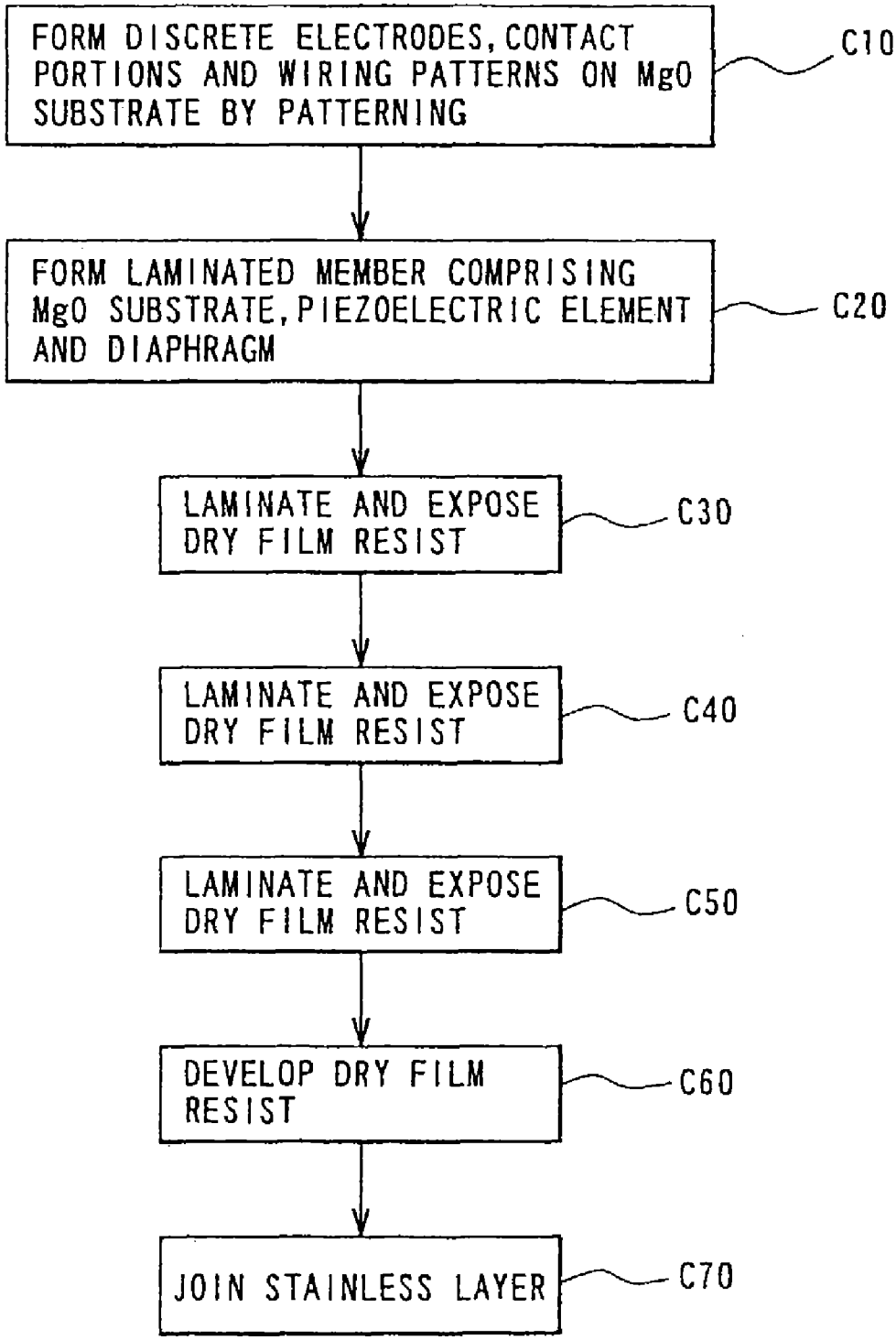

Furthermore, referring to FIGS. 11 to 14, a description will be given of a method of manufacturing an ink jet head according to the present invention. FIG. 11 is an illustration for explaining an ink jet head manufacturing method according to the first embodiment, and FIGS. 12 to 14 are flow charts for explaining this manufacturing method.

Figure 11A:
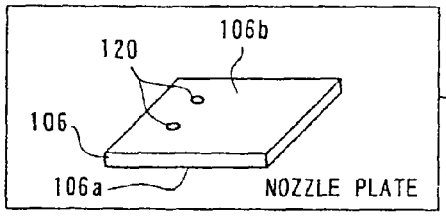
FIG. 11 is an illustration for explaining an ink jet head manufacturing method according to the first embodiment of the present invention.
Figure 11B:
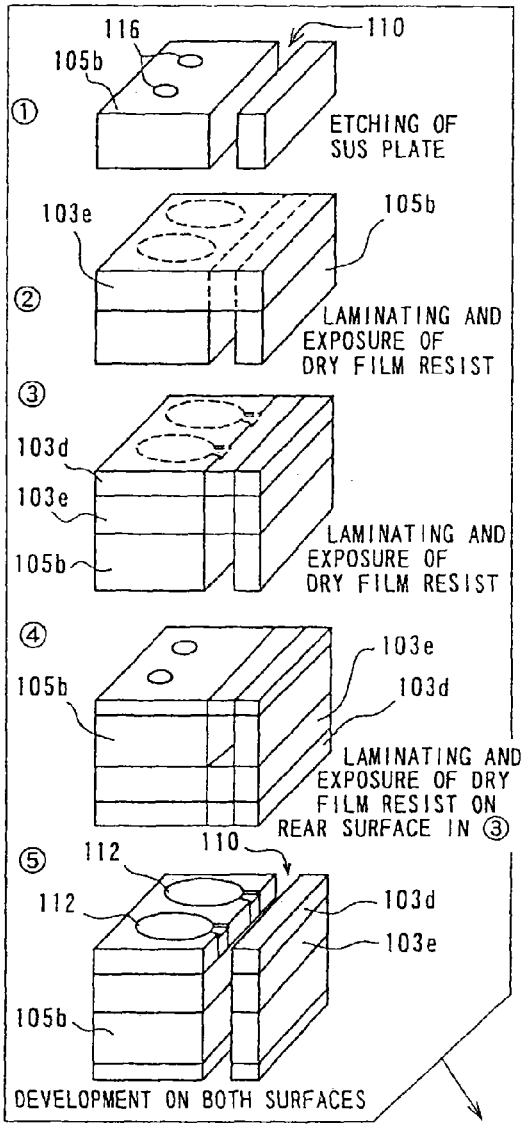
Figure 11C:
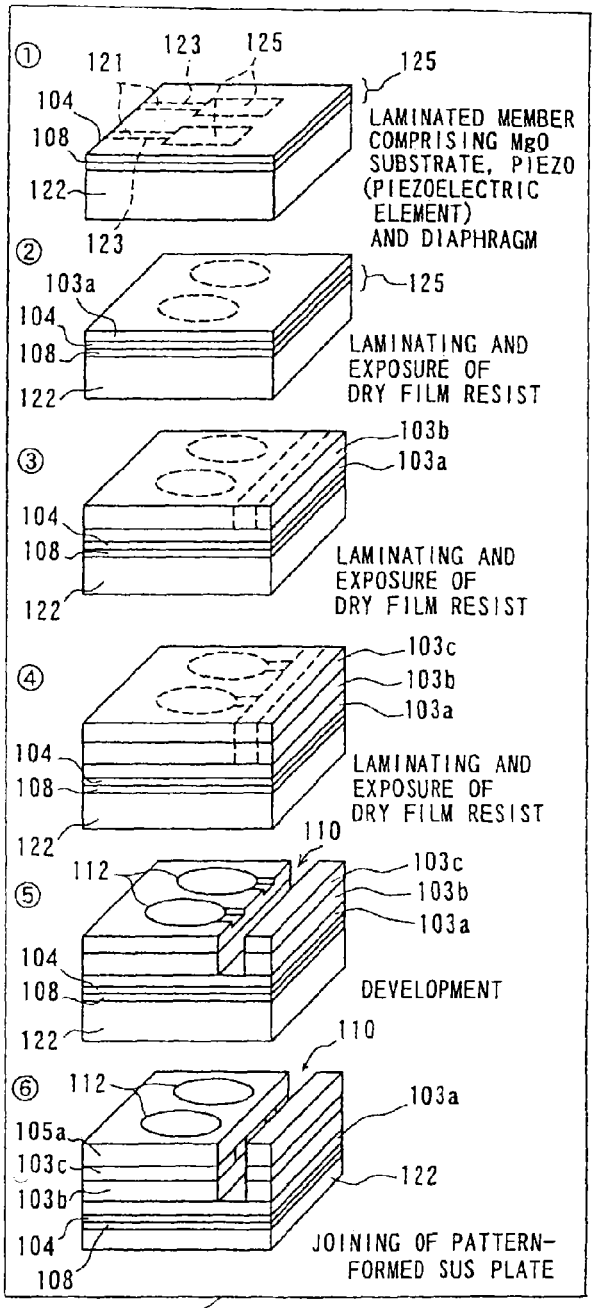
Figure 11D:
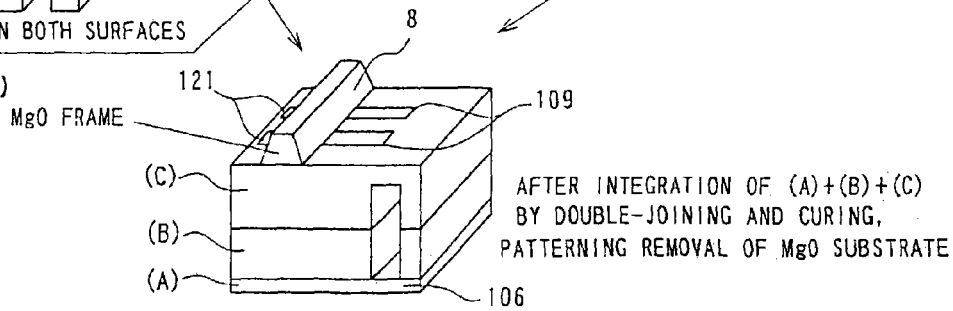
Figure 12:
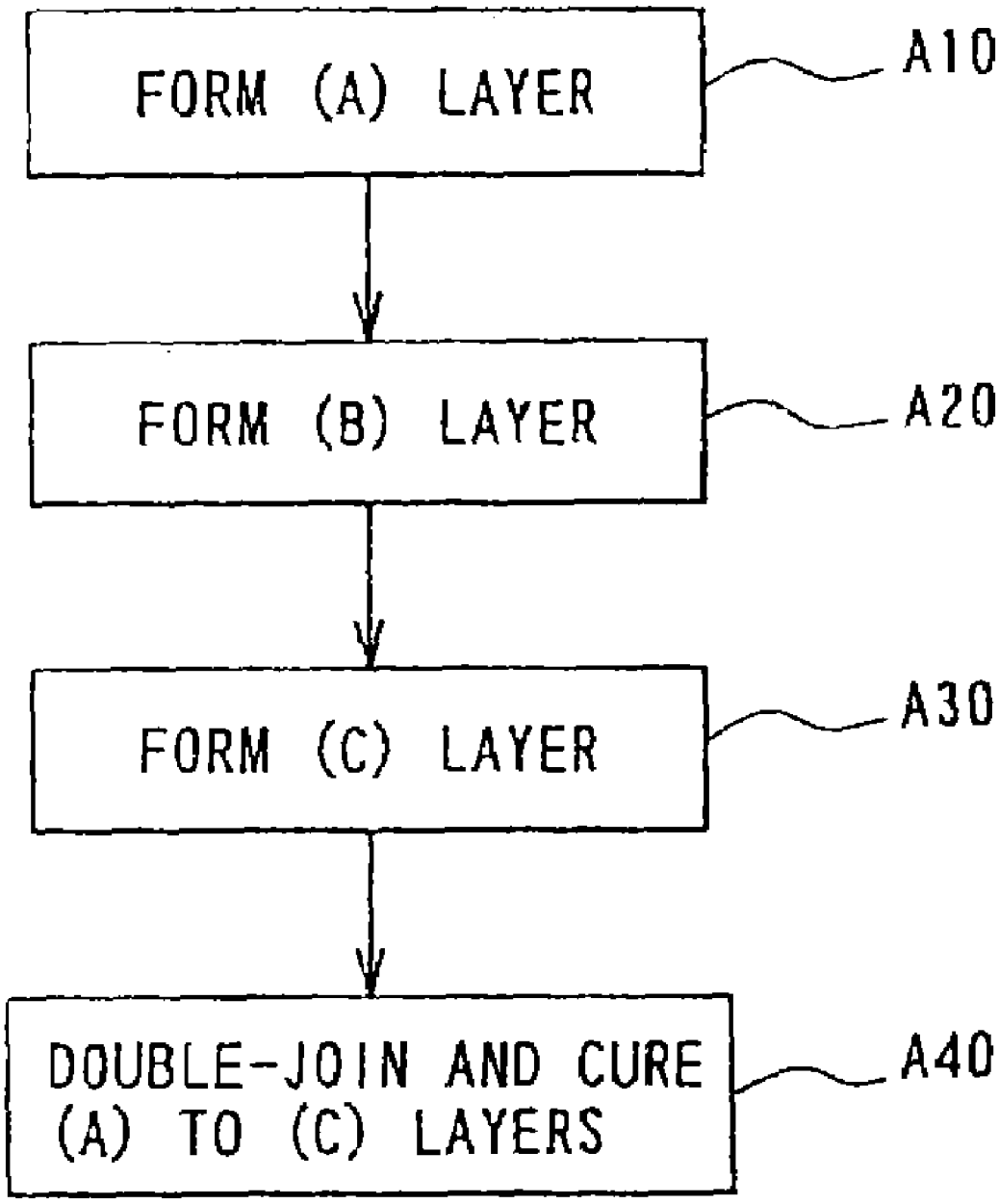
FIGS. 12 to 14 are flow charts for explaining the ink jet head manufacturing method according to the first embodiment of the present invention.

The ink jet head 100 according to the first embodiment is to be manufactured by means of a patterning method using dry film resists, with three layers being separately formed and heated at approximately 150° C., and then double-joined and cured (steps A10 to A40 in FIG. 12). Incidentally, in FIG. 11, only a portion including two pressure chambers adjacent to each other is illustrated for convenience only. Moreover, each of steps A10 to A40 in FIG. 12 can be implemented prior to other steps or concurrently therewith.

First of all, as FIG. 11(A) and 5 show, a nozzle plate 106 ((A) layer) in which nozzles 120 are made is formed using a metal such as stainless (SUS) by means of micropress processing (step A10). Each of the nozzles 120 is preferably machined into a conical configuration (tapered configuration in cross section), enlarged from a front surface 106*a* (jointed to a stainless plate 105*b*) toward a rear surface 106*b*, by means of a punch (not shown) using a pin, or by other means.

In this case, if the nozzle plate 106 is joined to the stainless plate 105*b* instead of they being constructed integrally, these conical nozzles 120 are producible.

Following this, as FIG. 11(B) shows, dry film resists are laminated on the stainless plate 105*b* to form a (B) layer (step A20 in FIG. 12). In more detail, the (B) layer is produced according to steps B10 to B50 in FIG. 13.

First, as shown by circled numeral 1 of FIG. 11(B), the stainless plate 105*b* having a rigidity is etched to form connecting passages 116 and a common ink passage 110 (step B10 in FIG. 13). Incidentally, the equipment and others required for the etching are known among those skilled in the art, and the detailed description thereof will be omitted.

Subsequently, as shown by circled numeral 2 of FIG. 11(B), the first-layer dry film resist 103 (equivalent to the dry film resist 103*e* in FIG. 5) is laminated on the stainless plate 105*b* and the portions corresponding to the pressure chambers 112 and the common ink passage 110 are exposed through the use of masking (step B20 in FIG. 13).

Incidentally, the equipment for realizing the laminating and exposure of the dry film resist are known among those skilled in the art, and the detailed description thereof will be omitted.

In the case of the employment of the dry film resist 103, preferably, a member (for example, stainless plate 105*b*, nozzle plate 106, MgO substrate 122 or the like) having a rigidity is used as a substrate and the dry film resist 103 is laminated thereon and then joined thereto. The member having a rigidity is not limited to the above-mentioned stainless plate or MgO substrate, but all changes which do not constitute departures from the spirit and scope of the invention are acceptable.

After this, as shown by circled numeral 3 of FIG. 11(B), the second-layer dry film resist 103 (equivalent to the dry film resist 103*d* in FIG. 5) is laminated on the first-layer dry film resist 103 (103*e*), and the portions corresponding to the pressure chambers 112, the ink supply passages 114 and the common ink passage 110 are exposed through the use of masking (step B30 in FIG. 13).

Furthermore, as shown by circled numeral 4 of FIG. 11(B), a dry film resist is laminated as an adhesion layer on the rear surface of the stainless plate 105*b*, and the portions corresponding to the connecting passages 116 and the common ink passage 110 are exposed through the use of masking (step B40 in FIG. 13). In FIG. 5, the illustration of this adhesion layer is omitted for convenience only.

Still furthermore, the dry film resists on both the surfaces of the substrate are developed, thereby forming a (B) layer shown by circled numeral 5 of FIG. 11(B) (step B50 in FIG. 13).

In addition, as shown in FIG. 11(C), a (C) layer is formed by laminating a bimorph laminated member and a dry film resist (step A30 in FIG. 12).

The (C) layer is made up of three dry film resist layers, and in more detail, the step A30 of FIG. 12 comprises steps C10 to C70 of FIG. 14.

First, as shown by circled numeral 1 of FIG. 11(C), discrete electrodes 109, contact portions 121 and wiring patterns 123 are patterned on an MgO substrate 122 (step C10 in FIG. 14), and a bimorph laminated member 125 comprising a piezoelectric element 108 and a diaphragm 104 is then formed thereon (step C20 in FIG. 14).

Concretely, the piezoelectric element 108 forming a single layer in a direction of the grid of the MgO substrate 122 is formed into a thin-film configuration according to a method of growing the piezoelectric element 108 over one surface of the MgO substrate 122 by sputtering, and a chromium film is then grown over the one surface of the piezoelectric element 108 by sputtering, plating or the like, thus forming the bimorph laminated member 125.

At this time, after a resist is applied onto the piezoelectric element 108 formed over the entire surface of the MgO substrate 122, a pattern for the piezoelectric element 108 corresponding to each of the pressure chamber 112 is processed by patterning while unnecessary piezoelectric elements 108 are removed by etching.

Moreover, a photosensitive liquid polyimide is applied on the entire surface of the MgO substrate 122 where the piezoelectric element 108 exists, and the exposure is then made throughout the surface of the MgO substrate 122 opposite to the surface holding the piezoelectric element 108 for exposing only the polyimide just on the MgO substrate 122.

Thereafter, the photosensitive liquid polyimide is developed and the non-exposed polyimide on the piezoelectric element 108 is removed so that a polyimide 126 is laid in only the area on the diaphragm 104 where the piezoelectric element 108 and the discrete electrodes 109 are absent.

In this connection, the formation of the piezoelectric element 108 and the diaphragms 104 on the MgO substrate 122 enables stable formation of the bimorph laminated member 125 and stable formation of the dry film resists 103*a* to 103*c* which will be mentioned later.

Still moreover, in the case of the employment of a piezoelectric element having a laminated structure as the piezoelectric element 108, for example, a plurality of green sheets are mixed into a solvent such as ceramic powder to produce a paste-like material and then formed into a thin film configuration having a thickness of approximately 50 μm by means of a doctor blade. As the material for the piezoelectric element 108, it is possible to use a ferroelectric substance, such as Ba, $TiO_3$, $PbTiO_3$ or $(NaK)NbO_3$ which is a material used usually for piezoelectric elements.

In this case, a first internal electrode pattern is printed and formed on one surfaces of three of a plurality of (for example, 12) green sheets, while a second internal electrode is printed and formed on one surfaces of another three green sheets different from the first-mentioned green sheets. For the printing of the first and second internal electrodes, the patterns are formed in a manner that a powdered alloy of silver and palladium is mixed into a solvent to produce a paste-like material and applied thereonto.

Subsequently, the three green sheets each having the first internal electrode and the three green sheets each having the second internal electrode are alternately stuck and the six green sheets each having no internal electrode are then stuck to produce a laminated structure of the piezoelectric element, and these green sheets are calcined in the laminated condition. In this case, the green sheets each having no internal electrode function as a substrate section.

Moreover, as shown by circled numeral 2 of FIG. 11(C), the first-layer dry film resist 103 (equivalent to the dry film resist 103*a* in FIG. 5) is laminated on the diaphragm 104 and the portions corresponding to the pressure chambers 112 are then exposed through the use of the masking (step C30 in FIG. 14).

Still moreover, as shown by circled numeral 3 of FIG. 11(C), the second-layer dry film resist 103 (equivalent to the dry film resist 103*b* in FIG. 5) is laminated on the first-layer dry film resist 103*a*, and the portions corresponding to the pressure chambers 112 and the common ink passage 110 are then exposed through the use of the masking (step C40 in FIG. 14).

Furthermore, as shown by circled numeral 4 of FIG. 11(C), the third-layer dry film resist 103 (equivalent to the dry film resist 103*c* in FIG. 5) is laminated on the second-layer dry film resist 103*b* and the portions corresponding to the pressure chambers 112, the ink supply passages 114 and the common ink passage 110 are then exposed through the use of the masking (step C50 in FIG. 14).

Still furthermore, as shown by circled numeral 5 of FIG. 11(C), the dry film resists are developed (step C60 in FIG. 14), and the piezoelectric element 108 to the dry film resist 103*c* in FIG. 5 are laminated on the MgO substrate 122 to form a laminated member, and as shown by circled numeral 6 of FIG. 11(C) a stainless plate 105*a* in which the portions corresponding to the pressure chambers 112 and the common ink passage 110 are removed in advance by etching is joined onto the dry film resist 103*c* (step C70 in FIG. 14).

In the first embodiment, as FIGS. 11 shows, the joint surfaces of the (A) to (C) layers are two in number, that is, between the (A) layer and the (B) layer and between (B) layer and the (C) layer, and therefore, there are two layers of stainless plates 105*a* and 105*b*.

In addition, the (A) layer to the (C) layer are joined and cured (step A40 in FIG. 12).

Owing to the use of the stainless plate 105*a*, in joining the (C) layer to the (B) layer, it is possible to prevent the dry film resist 103*c* and others from flowing into the dry film resist 103*d*.

Thereafter, the dry film resists 103*a* to 103*e* are cured when pressed and heated, thereby producing an integrated construction of the MgO substrate 122 to the nozzle plate 106.

Moreover, a resist is applied onto an MgO surface and the patterning exposure is conducted to a predetermined configuration conforming to the shape of the joint section 8, and the resist is then developed and the unnecessary portions of the MgO substrate 122 are removed by etching, thus forming the joint section 8 as a residual portion of the MgO substrate (substrate) 122 on the head main-body 3.

The contact portions 121 and 127 of the head main body 3 formed in this way are coupled through the FPC 2 and Au bumps for electrical connection, and the ink tank (ink supply part) 50 made by resin molding or the like or an ink tank fixing member are adhered through an adhesive or the like to the joint section 8 and cured, thus completing the ink jet head 100.

Incidentally, the step of removing the MgO substrate 122 for the formation of the joint section 8 is not limited to the implementation after the (A) layer to the (C) layer are joined and cured, but, for example, it can also be conducted after the formation of the (C) layer, and all changes which do not constitute departures from the spirit and scope of the invention are acceptable.

For example, the dimensions of the respective portions of the ink jet head 100 according to the first embodiment are determined as follows, where L represents a length, W denotes a width and t depicts a thickness (depth).

Discrete Electrode: L×W×t=1700 (μm)×70 (μm)×0.2 (μm)

Wiring Pattern W×t=5 (μm)×0.2 (μm)

(However, the length varies with elements.)

Piezoelectric Element (Piezo): L×W×t=1700 (μm)×70 (μm)×3 (μm)

Diaphragm: t=2 (μm)

Pressure Chamber: L×W×t=1700 (μm)×100 (μm)×130 (μm)

Ink Supply Passage: L×W×t=125 (μm)×15 (μm)×30 (μm)

Connecting Passage: ϕ80 (μm)×60 (μm)

Nozzle: ϕ20 (μm)×20 (μm)

Communicating Passage: L×W×t=13 (mm)×1 (mm)×0.19 (mm)

MgO Substrate: W×t=20 (mm)×0.3 (mm)

MgO Etching Taper Angle: 45 (deg)

(However, this value varies according to the etching conditions. In the first embodiment, 80° C.×(h) was applied for a solution of 50% of phosphoric acid, and the same value was obtained.)

Nozzle Pitch 1/150 (inch)

Number of Nozzles: 64

The ink jet head 100 according to the first embodiment of the present invention is constructed as described above, and for the printing, the ink held in the ink tank 50 is supplied through the ink supply port 51 and a communicating passage 81 to the common ink passage 110 and further supplied from this common ink passage 110 through the ink supply passage 114 to each of the pressure chambers 112.

In addition, drive signals produced by drive circuits or the like, not shown, are transmitted through the FPCs 2 to the contact portions 121 and 127, and the pressure chambers 112 are pressurized by the ink pressurizers 140 so that the ink jets out from the nozzles 120, thereby conducting the printing to the printing paper 200.

Thus, with the ink jet head 100 according to the first embodiment of the present invention, since the joint section 8 enhances the rigidity of the head main body 3, in manufacturing the ink jet head 100, the head main body 3 becomes unbreakable, which leads to the improvement of productivity thereof.

Still additionally, the ink tank 50 or an ink tank fixing member can easily be joined to the head main body 3.

Yet additionally, the discrete electrode 109 and the contact portion 121 are electrically connected to each other through a thin-film made wiring pattern 123, and this eliminates the need for the air wiring or the like using the wire bonding or the like, which enhances the nozzle packaging density, achieves the size reduction of the ink jet head, eliminates a possibility of damaging the head main body 3, and preventing short circuits among the wirings.

Moreover, on the surface of the head main body 3 where the discrete electrodes 109, the contact portions 121, 127 and the wiring patterns 123 exist, the joint section 8 is formed into a frame-like configuration surrounding the discrete electrodes 109, and the contact portions 121 and 127 are located outside the joint section 8, thereby enabling easy and certain electrical connection between the FPCs 2 and the discrete electrodes 109.

Still moreover, in a case in which the ink tank 50 or an ink tank fixing member is joined to the head main body 3, the adhesion allowance therefor can be made smaller, which leads to the reduction in the size of the head main body 3, thus resulting in the size reduction of the ink jet head and the printer (ink jet printer) as well.

Yet moreover, for the electrical connection between each of the discrete electrodes 109 and each of the contact portions 121, the wiring pattern 123 is placed to pass between the joint section 8 and the head main body 3, which enables the electrical connection between the FPC, for supplying signals to control the pressurizers 140, and each of the discrete electrodes 109 while eliminating the influence of the joint section 8.

Furthermore, since the head main body 3 is formed on the MgO substrate 122 and the MgO substrate 122 is partially removed from the head main body 3 to establish the common ink passage 110 and, further, the joint section 8 is formed as a residual portion of the MgO substrate 122 on the head main body 3, the joint section 8 is easily producible at a low cost.

(B) Description of First Modification of First Embodiment

Figure 15:
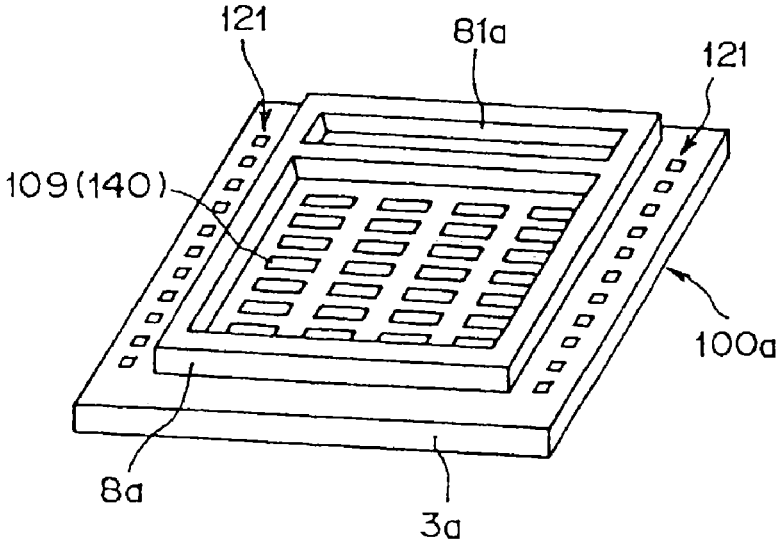
FIG. 15 is a perspective view showing a construction of a head main body of an ink jet head according to a first modification of the first embodiment of the present invention.
Figure 16:
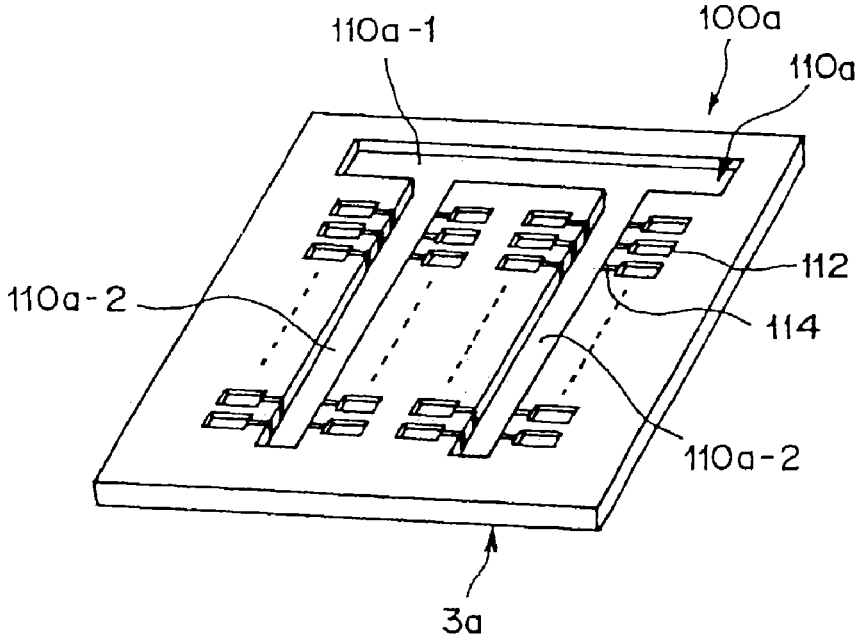
FIG. 16 is a perspective view showing a horizontal cross-section of the head main body in FIG. 15.

FIGS. 15 and 16 are illustrations for explaining a first modification of the ink jet head according to the first embodiment. FIG. 15 is a perspective view showing a construction of a head main body of an ink jet head according to a first modification of the first embodiment of the present invention, and FIG. 16 is a perspective view showing a horizontal cross-section of the head main body in FIG. 15.

Incidentally, in the illustrations, the same reference numerals as those used above designate the same or almost same portions, and the detailed description thereof will be omitted.

As FIG. 15 shows, as well as the above-described ink jet head 100 according to the first embodiment, an ink jet head 100*a* according to this first modification also has a plurality of nozzles (not shown) for discharging ink supplied from an ink tank (ink supply section; not shown), and equipped with a head main body 3*a* and a joint section 8*a*.

In place of the communicating passage 81 with a circular opening in the ink jet head 100 according to the first embodiment, the ink jet head 100*a* has a communicating passage 81*a* with a rectangular opening formed throughout the overall width (right-left direction of paper in FIG. 15) of the head main body 3*a*. The head main body 3*a* is designed to be connected through this communicating passage 81*a* to the ink tank.

Furthermore, the head main body 3*a* internally includes a common ink passage 110*a*, and each of the plurality of nozzles has a pressure chamber 112, a pressurizer 140 and an ink supply passage 114.

As FIG. 16 shows, the common ink passage 110*a* is composed of a first common ink passage 110*a*-1 formed throughout the almost overall width of the head main body 3*a*, and two second common ink passages 110*a*-2 formed in parallel with each other and formed perpendicularly to the first common ink passage 110*a*-1.

In addition, with respect to these second common ink passages 110*a*-2, a plurality of pressure chambers 112 are placed at opposed positions interposing each of the second common ink passages 110*a*-2 to establish a branched configuration, and each of the pressure chambers 112 and the common ink passage 110*a* (second common ink passages 110*a*-2) are made to communicate through the ink supply passage 114 with each other.

Incidentally, also in the common ink passage 110*a*, as in the case of the above-described common ink passage 110, the ink flow resistance is adjusted to absorb the abrupt fluctuation of the internal pressure of each of the pressure chambers 112, and after the pressure chamber 112 is contraction-pressurized for discharging the ink, at the return, a necessary amount of ink is supplied through the ink supply passage 114 to the pressure chamber 112. This ink supply is also done under the adjustment of the flow resistance.

Still additionally, also in the head main body 3*a*, the pressure chambers 112 are arranged in one direction to stand in lines, and the pressure chambers 112 are designed to accommodate ink when supplied and to discharge the ink from the nozzles through connecting passages 116 in response to an increase in their internal pressure.

As FIG. 15 shows, the joint section 8*a* is formed to protrude from the surface of the head main body 3*a* (the side where the discrete electrodes 109 exist in the head main body 3*a*) opposite to the nozzle formation side thereof, and is formed to surround the discrete electrodes 109 on the surface of the head main body 3*a* where the discrete electrodes 109 exist.

That is, the joint section 8*a* is formed to surround the discrete electrodes 109 on the surface where the discrete electrodes 109, the contact portions 121 and the wiring patterns (not shown) exist.

In addition, a portion of the joint section 8*a* is made to surround the communicating passage 81*a*. The ink tank (ink supply part) is joined to the head main body 3*a* in a manner that the ink tank or an ink tank fixing member is joined through an adhesive or the like to the joint section 8*a*, and even at the joining of the ink tank to the joint section 8*a*, this prevents the ink supplied from the ink tank to the communicating passage 81*a* from flowing out toward the discrete electrode 109 side.

In this connection, as well as the joint section 8 in the ink jet head 100 according to the first embodiment, the joint section 8*a* has a cross-sectional configuration, tapered to be narrower at the top, whereby an adhesive forced out is held by its slopes to prevent the forced-out adhesive from reaching the head main body 3*a*.

Moreover, as well as the above-mentioned joint section 8, the substrate made of magnesium oxide (MgO) is partially removed from the head main body 3*a* by means of photoetching, thereby forming the joint section 8*a* as a residual portion of the substrate on the head main body 3*a*.

On the surface of the head main body 3*a* where the discrete electrodes 109 exist, as well as the head main body 3 of the ink jet head 100 according to the first embodiment, a plurality of contact portions 121 are formed in the vicinity of an outer edge portion of the head main body 3, concretely, outside the joint section 8*a*.

Since the ink jet head 100*a* constituting the first modification of the first embodiment of the present invention is constructed as described above, in a case in which the ink tank or the ink tank fixing member is joined through an adhesive or the like to the joint section 8*a*, even if the adhesive is forced out from between the joint section 8*a* and the ink tank, that adhesive does not reach the pressurizers 140 such as the discrete electrodes 109 or the like, which prevents the interference with the pressuring operations, thus leading to the improvement of the print quality of the ink jet head.

Subsequently, when the ink is supplied from the ink supply port of the ink tank through the communicating passage 81*a* to the head main body 3*a*, this ink passes through the first common passage 110*a*-1 and the second common ink passage 110*a*-2 and further proceeds through each of the ink supply passages 114 to each of the pressure chambers 112.

In addition, when a drive circuit or the like, not shown, supplies a drive signal through the FPC (not shown) to each of the discrete electrodes 109, the pressure chamber 112 is pressurized by the pressurizer 140, thereby discharging the ink from each of the nozzles.

Thus, with the first modification of the ink jet head according to the first embodiment of the present invention, in addition to the effects similar to those of the first embodiment mentioned above, since the ink from the ink tank is supplied through the communicating passage 81*a* with the rectangular cross section, formed throughout the almost overall width of the head main body 3*a*, and the common ink passage 110*a*-1 to the head main body 3*a*, the ink can stably be supplied even to the terminal portion of the common ink passage 110, that is, the pressure chambers 112 located in the vicinity of the common ink passage 110*a*-2 side opposite to the side connected to the common ink passage 110*a*-1.

That is, since the ink pressures in the pressure chambers 112 can be made even, the discharged amounts of the ink to be discharged from the nozzles, or the like, are equalized, thus improving the print quality.

(C) Description of Second Modification of First Embodiment

Figure 17:
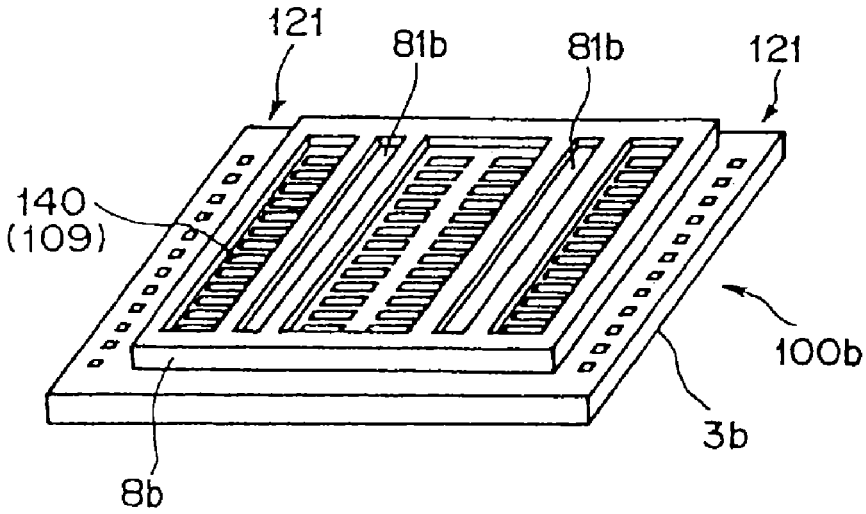
FIG. 17 is a perspective view showing a construction of a head main body of an ink jet head according to a second modification of the first embodiment of the present invention.
Figure 18:
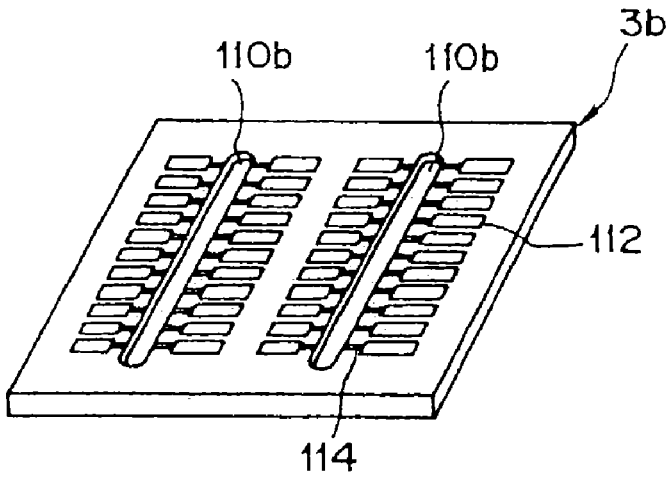
FIG. 18 is a perspective view showing a horizontal cross-section of the head main body in FIG. 17.

FIGS. 17 and 18 are illustrations for explaining a second modification of the ink jet head according to the first embodiment. FIG. 17 is a perspective view showing a construction of a head main body of an ink jet head according to a second modification of the first embodiment of the present invention, and FIG. 18 is a perspective view showing a horizontal cross-section of the head main body in FIG. 17.

Incidentally, in the illustrations, the same reference numerals as those used above designate the same or almost same portions, and the detailed description thereof will be omitted.

As FIG. 17 shows, as well as the above-described ink jet head 100 according to the first embodiment, an ink jet head 100*b* according to this second modification has a plurality of nozzles (not shown) for discharging ink supplied from an ink tank (ink supply section; not shown), and is made up of a head main body 3*b* and a joint section 8*b*.

In this ink jet head 100*b*, in place of the communicating passage 81 of the ink jet head 100 according to the first embodiment, two communicating passages 81*b* each having a rectangular opening are formed in parallel with each other to extend throughout the nearly overall length of the head main body 3*b* in its longitudinal directions (in FIG. 17, a direction parallel with a surface on the contact portion 121 formation side). Moreover, the head main body 3*b* is connected through these communicating passages 81*b* to the ink tank.

In addition, in the head main body 3*b*, each of the plurality of nozzles has a pressure chamber 112, a pressurizer 140 and an ink supply passage 114.

As FIG. 18 shows, in the head main body 3*b*, two common ink passages 110*b* formed in parallel with each other are made through the nearly overall length of the head main body 3*b* in its longitudinal directions (in FIG. 17, directions parallel with a surface on the contact portion 121 formation side).

Still additionally, with respect to these two common ink passages 110*b*, a plurality of pressure chambers 112 are placed in a branched configuration at opposed positions interposing each of the common ink passages 110*b*, and each of the pressure chambers 112 and each of the common ink passages 110*b* are made to communicate through the ink supply passage 114 with each other.

In this connection, as well as the above-described common ink passage 110 of the ink jet head 100 according to the first embodiment, also in the common ink passages 110*b*, the flow resistance of the ink is adjusted to absorb the abrupt fluctuation of the internal pressure in each of the pressure chambers 112, and after the pressure chamber 112 is contraction-pressurized to discharge the ink, at the return, a necessary amount of ink is made to be supplied through the ink supply passage 114 to the pressure chamber 112. Incidentally, this ink supply is also done under the adjustment of the flow resistance.

Yet additionally, the pressure chambers 112 are designed to accommodate ink when supplied and to discharge the ink from the nozzles 120 through connecting passages 116 in response to an increase in their internal pressure, and also in the head main body 3*b* of this ink jet head 100*b*, the pressure chambers 112 are arranged in one direction to stand in lines, and as shown in FIG. 17, the pressure chambers 112 are placed in parallel with each other to be perpendicular to the common ink passages 110*b* (communicating passages 81*b*).

As FIG. 17 shows, the joint section 8*b* is formed to protrude from the surface of the head main body 3*b* (the side where the discrete electrodes 109 exist in the head main body 3*b*) opposite to the nozzle formation side thereof, and is formed to surround the discrete electrodes 109 on the surface of the head main body 3*a* where the discrete electrodes 109 exist.

That is, the joint section 8*b* is made to surround the discrete electrodes 109 on the surface holding the discrete electrodes 109, the contact portions 121 and a wiring pattern (not shown).

In addition, a portion of the joint section 8*b* is made to surround the communicating passage 81*b*.

The ink tank (ink supply part) is joined to the head main body 3*b* in a manner that the ink tank or an ink tank fixing member is joined through an adhesive or the like to the joint section 8*b*, and even at the joining of the ink tank to the joint section 8*b*, this prevents the ink supplied from the ink tank to each of the communicating passages 81*b* from flowing out toward the discrete electrode 109 side.

In this connection, as well as the joint section 8 in the ink jet head 100 according to the first embodiment, the joint section 8*b* has a cross-sectional configuration, tapered to be narrower at the top, whereby an adhesive forced out is held by its slopes to prevent the forced-out adhesive from reaching the head main body 3*b*.

Moreover, as well as the, above-mentioned joint section 8, a substrate made of magnesium oxide (MgO) is partially removed from the head main body 3*b* by means of photoetching, thereby forming the joint section 8*b* as a residual portion of the substrate on the head main body 3*b*.

As well as the head main body 3 of the ink jet head 100 according to the first embodiment, on the surface of the head main body 3*a* where the discrete electrodes 109 exist, a plurality of contact portions 121 are formed in the vicinity of an outer edge portion of the head main body 3, concretely, outside the joint section 8*b*.

Since the ink jet head constituting the second modification of the first embodiment of the present invention is constructed as described above, when ink is supplied from an ink tank port of the ink tank through the communicating passages 81*b* to the head main body 3*b* after the ink tank or the ink tank fixing member is joined through an adhesive or the like to the joint section 8*b*, the ink passes through the common ink passages 110*b* and further enters each of the pressure chambers 112 through the each of the ink supply passages 114.

Still moreover, when a drive circuit or the like, not shown, supplies a drive signal through the FPC (not shown) to each of the discrete electrodes 109, the pressure chamber 112 is pressurized by the pressurizer 140, thereby discharging the ink from each of the nozzles.

Thus, with the second modification of the ink jet head according to the first embodiment of the present invention, in addition to the effects similar to those of the first embodiment mentioned above, since the supply distances of the ink from the ink tank to the pressure chambers 112 are equal among the pressure chambers 112, the stable ink supply to each of the pressure chambers 112 is achievable. This can equalize the discharging amount of the ink discharged from each of the nozzles, or the like, thus leading to the improvement of the print quality.

(D) Description of Third Modification of First Embodiment

Figure 19A:
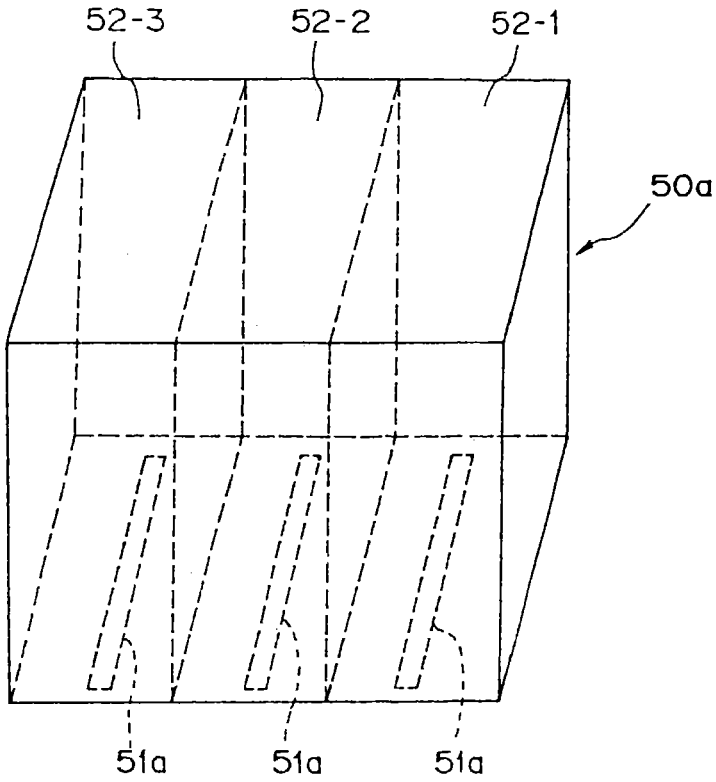
FIG. 19(*a*) is a perspective view for explaining an ink tank configuration, showing an ink tank of an ink jet head according to a third modification of the first embodiment of the present invention.
Figure 19B:
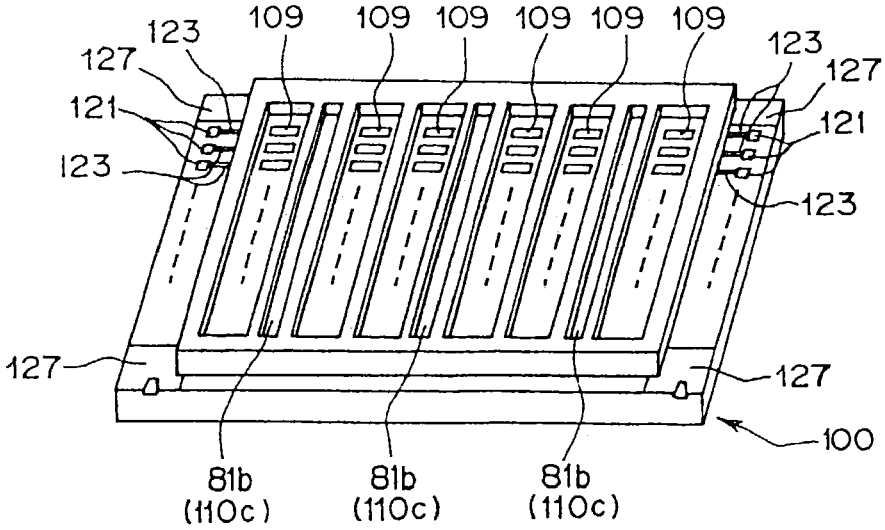

FIGS. 19(*a*) and (*b*) are illustrations for explaining a third modification of the ink jet head according to the first embodiment. FIG. 19(*a*) is a perspective view for explaining an ink tank configuration, showing an ink tank of an ink jet head according to a third modification of the first embodiment of the present invention, and FIG. 19(*b*) is a perspective view showing a construction of a head main body of the ink jet head according to the third modification of the first embodiment of the present invention.

Incidentally, in the illustrations, the same reference numerals as those used above designate the same or almost same portions, and the detailed description thereof will be omitted.

As FIG. 19(*b*) shows, an ink jet head 100*c* according to this third modification is for performing color printing using a plurality of (three colors of yellow, magenta and cyan in this modification) ink, and has nozzles (not shown) each for discharging each of the color ink, and is composed of a head main body 3*c* and a joint section 8*c*.

In the head main body 3*c*, each of the nozzles includes a pressure chamber 112, a pressurizer 140 and an ink supply passage 114.

The ink jet head 100*c* is designed to be joined through the joint section 8*c* to an ink tank (ink supply part) 50*a* holding three color ink of yellow, magenta and cyan.

As FIG. 19(*a*) shows, the ink tank 50*a* is constructed to have ink chambers 52-1 to 52-3 according to the number of ink to be used (three in the third modification). These ink chambers 52-1 to 52-3 are separated by partition walls, and are filled up with different kinds (colors) of ink. In the third modification, for example, the ink chamber 52-1 accommodates yellow ink, the ink chamber 52-2 accommodates cyan ink and the ink chamber 52-3 accommodates magenta ink.

In addition, each of the ink chambers 52-1 to 52-3 has an ink supply port 51*a* for supply of the ink, and these ink supply ports 51*a* are placed in parallel with each other. That is, the ink tank 51*a* is equipped with three ink supply ports 51*a* arranged in parallel with each other.

As FIG. 19(*b*) shows, in the head main body 3*c* of the ink jet head 100*c*, three communicating passages 81*b* similar to those of the ink jet head 100*b* formed in parallel with each other according to the second modification are formed throughout the nearly overall length of the head main body 3*c* in its longitudinal directions (in directions parallel to the surface on the contact portion 121 formation side in FIG. 19(*b*)), and in the head main body 3*c*, there are formed three common passages 110*c* each having the nearly same cross-sectional configuration as that of each of the communicating passages 81*b*.

Moreover, with respect to these three common ink passages 110*c*, a plurality of pressure chambers 112 are placed at opposed positions interposing each of the common ink passages 110*c* to set up a branched configuration, and each of the pressure chambers 112 and each of the common ink passages 110*c* are made to communicate through an ink supply passage 114 with each other.

That is, the head main body 3*c* is made to be connected through these communicating passages 81*b* to the ink tank 50*a* shown in FIG. 19(*b*).

In this connection, as well as the above-described common ink passage 110 of the ink jet head 100 according to the first embodiment, also in the common ink passages 110*c*, the flow resistance of the ink is adjusted to absorb the abrupt fluctuation of the internal pressure in each of the pressure chambers 112, and after the pressure chamber 112 is contraction-pressurized to discharge the ink, at the return, a necessary amount of ink is made to be supplied through the ink supply passage 114 to the pressure chamber 112. Incidentally, this ink supply is also done under the adjustment of the flow resistance.

In addition, the pressure chambers 112 are designed to accommodate ink when supplied and to discharge the ink from the nozzles 120 through connecting passages 116 in response to an increase in their internal pressure, and also in the head main body 3*c* of this ink jet head 100*c*, the pressure chambers 112 are arranged in one direction to stand in lines, and as shown in FIG. 19(*b*), the pressure chambers 112 are placed in parallel with each other to be perpendicular to the common ink passages 110*c*.

As FIG. 19(*b*) shows, the joint section 8*c* is formed to protrude from the surface of the head main body 3*c* (the side where the discrete electrodes 109 exist in the head main body 3*c*) opposite to the nozzle formation side thereof, and is formed to surround the discrete electrodes 109 on the surface of the head main body 3*c* where the discrete electrodes 109 exist.

That is, the joint section 8*c* is made to surround the discrete electrodes 109 on the surface holding the discrete electrodes 109, the contact portions 121 and a wiring pattern 123.

In addition, a portion of the joint section 8*c* is made to surround communicating passages 81*c*.

The ink tank (ink supply part) 50*a* is joined to the head main body 3*c* in a manner that the ink tank 50*a* or an ink tank fixing member is joined through an adhesive or the like to the joint section 8*c*, and even at the joining of the ink tank 50*a* to the joint section 8*c*, this prevents the ink supplied from the ink tank 50*a* to each of the communicating passages 81*b* from flowing out toward the discrete electrode 109 side.

Still additionally, as well as the joint section 8 in the ink jet head 100 according to the first embodiment, the joint section 8*c* has a cross-sectional configuration, tapered to be narrower at the top, whereby an adhesive forced out is held by its slopes to prevent the forced-out adhesive from reaching the head main body 3*c*.

Moreover, as well as the above-mentioned joint section 8 and others, a substrate made of magnesium oxide (MgO) is partially removed from the head main body 3*c* by means of photoetching, thereby forming the joint section 8*c* as a residual portion of the substrate on the head main body 3*c*.

Still moreover, as well as the head main body 3 of the ink jet head 100 according to the first embodiment, on the surface of the head main body 3*c* where the discrete electrodes 109 exist, a plurality of contact portions 121 are formed in the vicinity of an outer edge portion of the head main body 3, concretely, outside the joint section 8*c*.

Since the ink jet head constituting the third modification of the first embodiment of the present invention is constructed as described above, when each color ink is supplied from each of ink tank ports 51*a* of the ink tank 50*a* through each of the communicating passages 81*b* to the head main body 3*c* after the ink tank 50*a* is joined through an adhesive or the like to the joint section 8*c*, the ink passes through the common ink passages 110*c* and further enters each of the pressure chambers 112 through the each of the ink supply passages 114.

Yet moreover, when a drive circuit or the like, not shown, supplies a drive signal through the FPC (not shown) to each of the discrete electrodes 109, the pressure chamber 112 is pressurized by the pressurizer 140, thereby discharging the ink from each of the nozzles.

Thus, with the third modification of the ink jet head according to the first embodiment of the present invention, in addition to the effects similar to those of the second modification mentioned above, even in the case of the printing using a plurality of color ink, the discharging amounts of ink discharged from the nozzles can be equalized, thereby improving the print quality.

In addition, since the partitioning among the adjacent communicating passages 81*c* can be made by the joint section 8*c*, in a multi-color printable multi-nozzle ink jet head (ink jet head 100*c*), it is possible to enhance the positional accuracy of each of the nozzles 120 and further to form these nozzles 120 at a high density, thus achieving the size reduction of the ink jet head and the printer (ink jet printer) as well.

(E) Description of Fourth Modification of First Embodiment

Figure 20:
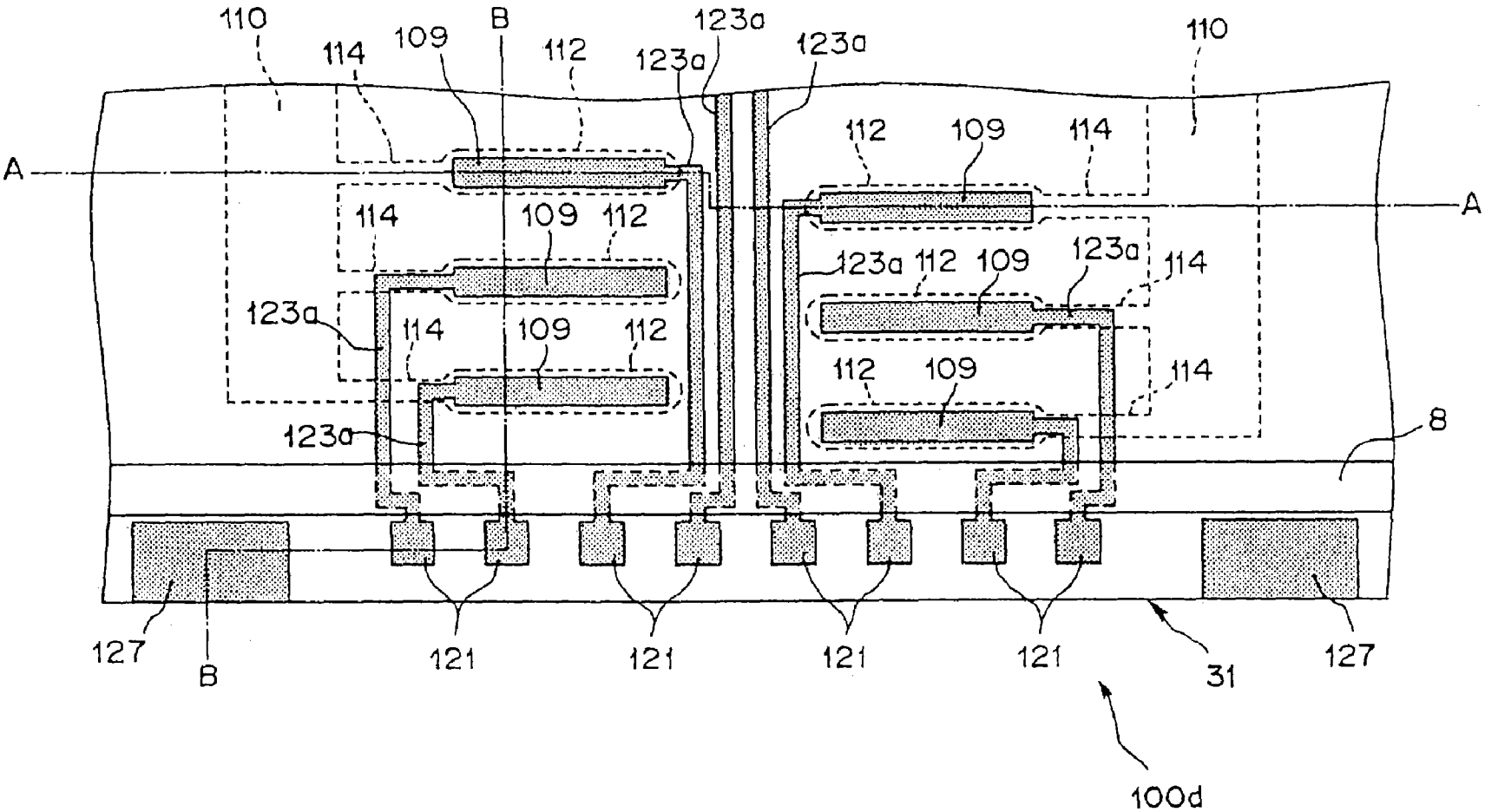
FIG. 20 is an enlarged plan view showing an essential part of a wiring pattern of an ink jet head according to a fourth modification of the first embodiment of the present invention.
Figure 21:
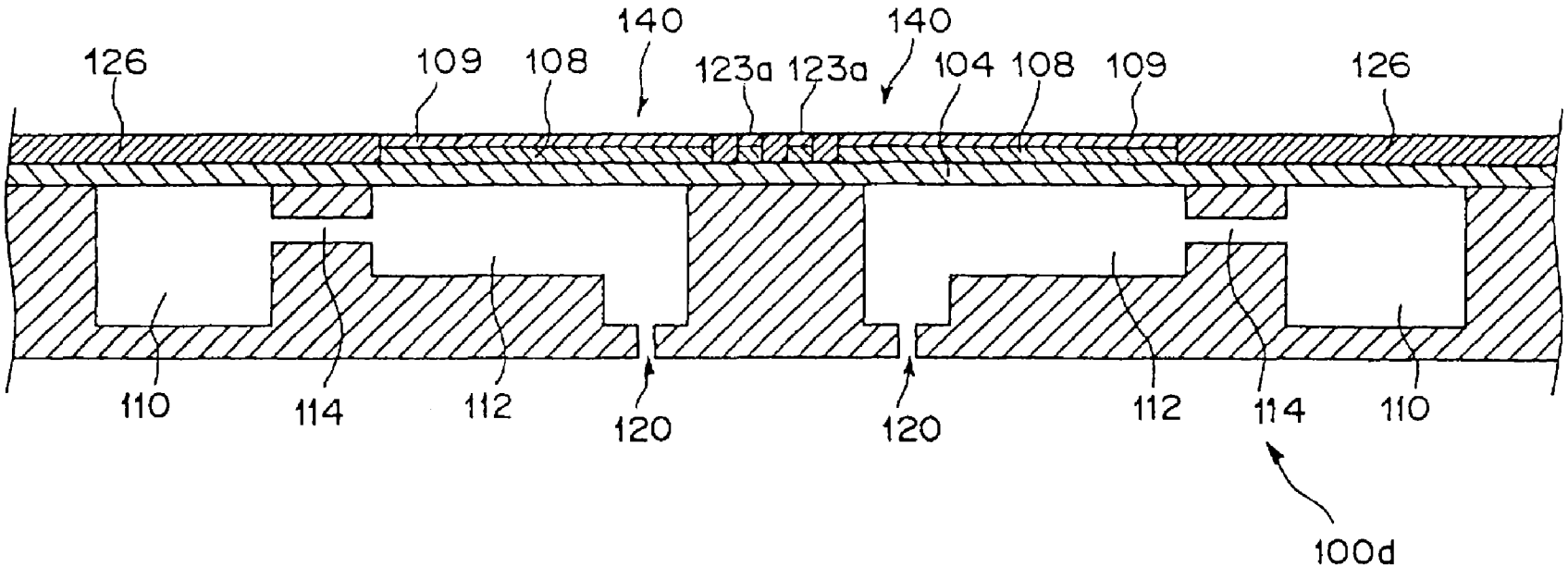
FIG. 21 is a cross-sectional view taken along a line A—A of FIG. 20.
Figure 22:
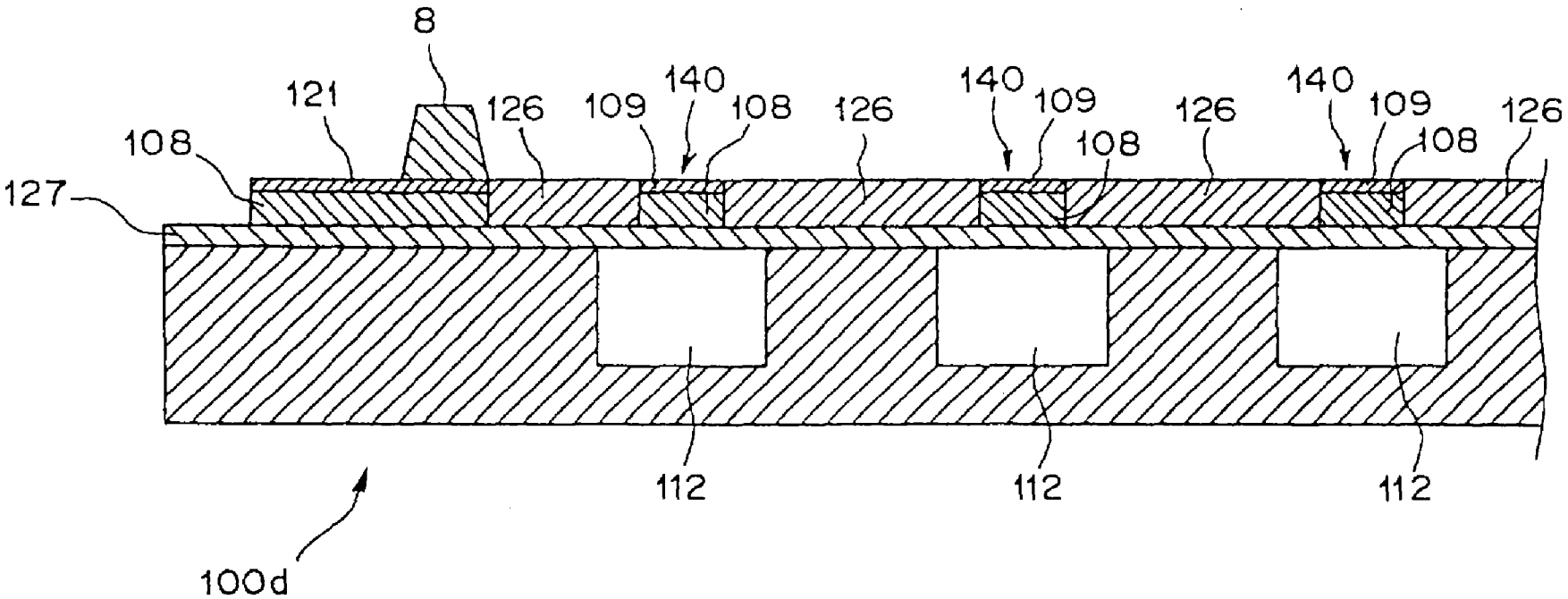
FIG. 22 is a cross-sectional view taken along a line B—B of FIG. 20.

FIGS. 20 to 22 are illustrations for explaining a construction of a wiring pattern in an ink jet head constituting a fourth modification of the first embodiment of the present invention. FIG. 20 is an enlarged plan view showing an essential part of a wiring pattern of an ink jet head according to a fourth modification of the first embodiment of the present invention, FIG. 21 is a cross-sectional view taken along a line A—A of FIG. 20, and FIG. 22 is a cross-sectional view taken along a line B—B of FIG. 20.

In the illustrations, the same reference numerals as those used above designate the same or nearly same parts, and the detailed description will be omitted.

In place of the writing patterns 123 in the ink jet head 100 according to the first embodiment, an ink jet head 100*d* according to the fourth modification of the first embodiment of the present invention has wiring patterns 123*a*, and a detailed description thereof will be given hereinbelow with reference to FIGS. 20 to 22.

As FIGS. 20 to 22 show, as in the case of the above-described ink jet head 100 according to the first embodiment, the ink jet head 100*d* according to this fourth modification has a plurality of nozzles 120 each for discharging ink supplied from an ink tank (ink supply section), not shown, and is made of a head main body 31 and a joint section 8.

In addition, as well as the above-described ink jet head 100, the ink jet head 100*d* according to the fourth modification is also made by piling up a plurality of layers such as dry film resists 103*a* to 103*e*, stainless plates 105*a*, 105*b* and others, but in FIGS. 21 to 22, this laminated structure is omitted from the illustration for convenience only.

As FIGS. 20 to 22 shows, on the head main body 31, the wiring patterns 123*a*, together with discrete electrodes 109 and contact portions 121, are formed by means of patterning, and hence, the wiring patterns 123*a*, the discrete electrodes 109 and the contact portions 121 are made integrally from the same material in the form of a thin film on the same plane.

As FIG. 20 shows, these wiring patterns 123*a* are located in nearly parallel with the longitudinal directions (right-left directions in FIG. 20) of the discrete electrodes 109 to pass between them, and as FIG. 22 shows, the wiring patterns 123*a* is positioned below the joint section 8, that is, placed to pass between the head main body 31 and the joint section 8.

In addition, as well as the ink jet head 100 shown in FIG. 11, in the head main body 31, on the surface of the head main body 3 on the formation side of the discrete electrodes 109 and others, a diaphragm 104 is exposed outside the joint section 8, that is, in the vicinity of corner portions of the head main body 31, thereby forming contact portions 127.

Still additionally, an FPC (external connection wiring member; not shown in FIGS. 20 to 22) is electrically connected to these contact portions 121 and 127 through the use of a TAB method.

Moreover, as well as the ink jet head 100 according to the first embodiment, the ink jet head 100*d* according to the fourth modification is made to be formed according to a patterning method using dry film resists, and the wiring patterns 123*a*, together with the discrete electrodes 109 and the contact portions 121, are also formed on the head main body 31 by means of the patterning, and the wiring patterns

123*a*, the discrete electrodes 109 and the contact portions 121 are integrally made as a thin film from the same material on the same plane.

With the above-mentioned construction, after the FPC is electrically connected to the contact portions 121 and 127 according to the TAB method or the like, a drive circuit or the like, not shown, supplies a drive signal through the FPC to each of the discrete electrodes 109 so that the pressure chamber 112 is pressurized by the pressurizer 140 to cause the ink to be discharged from each of the nozzles 120.

As described above, also with the ink jet head constituting the fourth modification of the first embodiment of the present invention, in making the electrical connection between each of the discrete electrodes 109 and each of the contact portions 121, each of the discrete electrodes 109 can be electrically connected to the FPC, which supplies signals for the control of the pressurizers 140, without being affected by the joint section 8, which provides the effects similar to those of the above-described first embodiment.

(F) Description of Fifth Modification of First Embodiment

Figure 23:
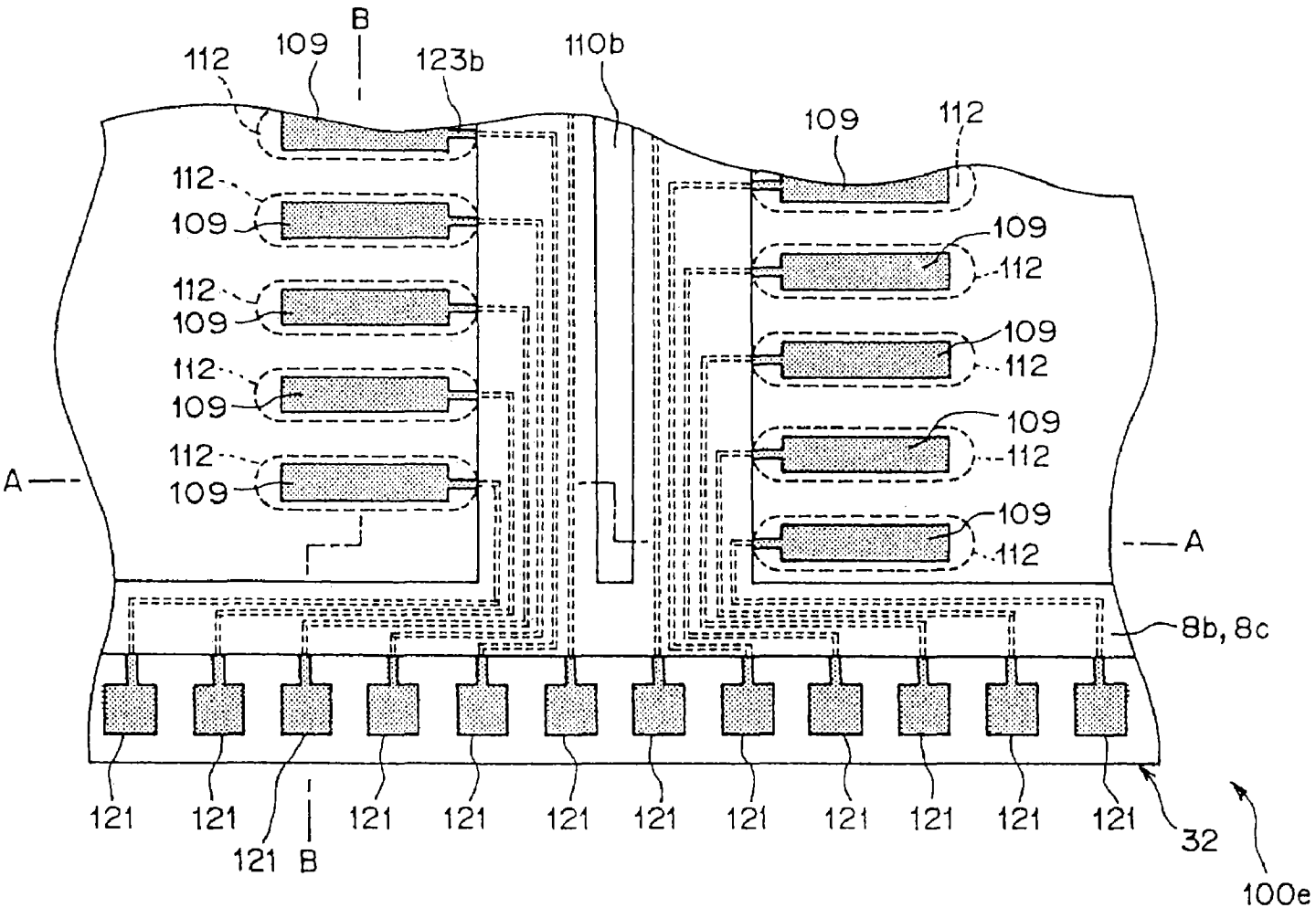
FIG. 23 is an enlarged plan view showing an essential part of wiring patterns of an ink jet head according to a fifth modification of the first embodiment of the present invention.
Figure 24:
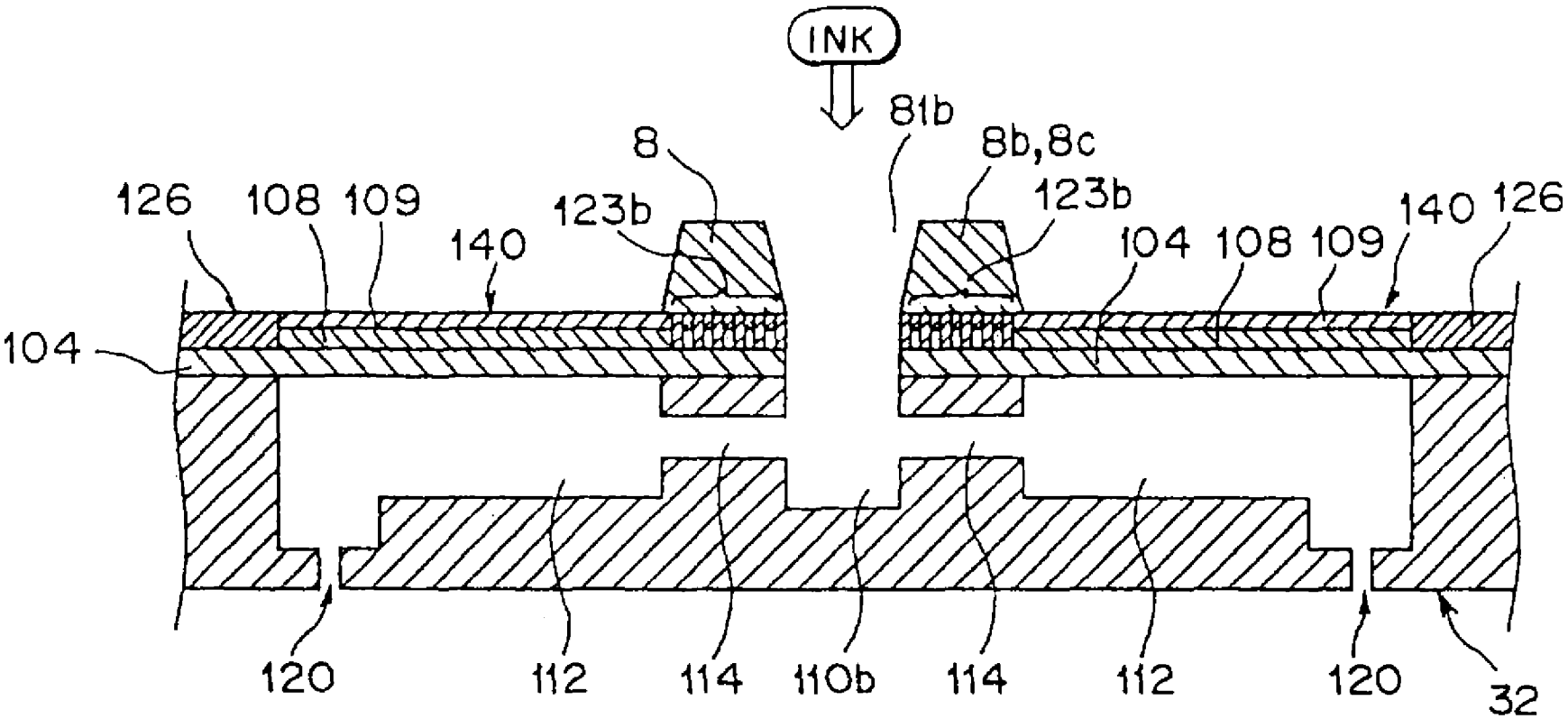
FIG. 24 is a cross-sectional view taken along a line A—A of FIG. 23.
Figure 25:
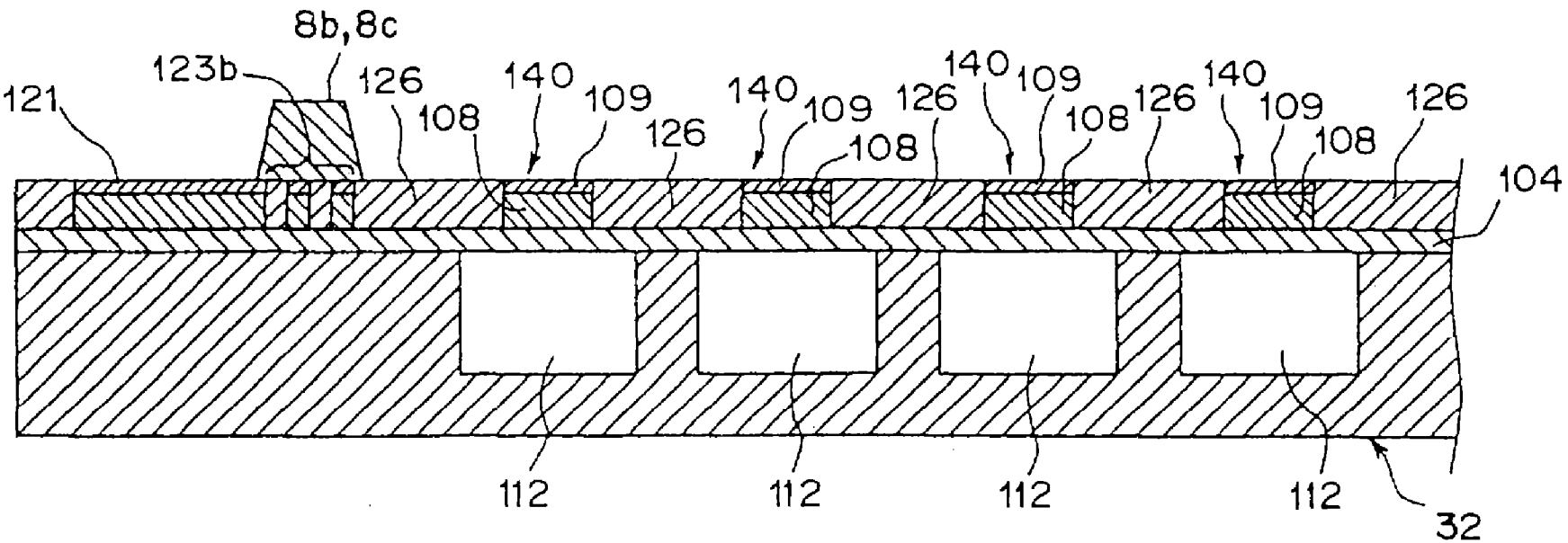
FIG. 25 is a cross-sectional view taken along a line B—B of FIG. 23.

FIGS. 23 to 25 are illustrations for explaining a configuration of wiring patterns in an ink jet head 100*e* according to a fifth modification of the first embodiment of the present invention. FIG. 23 is an enlarged plan view showing an essential part of wiring patterns of an ink jet head according to a fifth modification of the first embodiment of the present invention, FIG. 24 is a cross-sectional view taken along a line A—A of FIG. 23, and FIG. 25 is a cross-sectional view taken along a line B—B of FIG. 23.

In the illustrations, the same reference numerals as those used above designate the same or nearly same parts, and the detailed description will be omitted.

An ink jet head 100*e* according to the fifth modification of the first embodiment of the present invention has wiring patterns 123*b* in place the wiring patterns 123 in the ink jet head 100*b* shown in FIGS. 17 and 18 or in the ink jet head 100*c* shown in FIG. 19, and the configuration thereof will be described with reference to FIGS. 23 to 25.

As FIGS. 23 to 25 show, as well as the above-described ink jet heads 100*b* and 100*c*, the ink jet head 100*e* according to this fifth modification also has a plurality of nozzles 120 each for discharging ink supplied from an ink tank (ink supply section; not shown in FIGS. 23 to 25), and is made up of a head main body 32 and a joint section 8*b* (8*c*).

In addition, as in the case of the above-described ink jet head 100, the ink jet head 100*e* according to the fifth modification is also made by piling up a plurality of layers including dry film resists 103*a* to 103*e*, stainless plates 105*a* and 105*b* and others, and in FIGS. 24 and 25, this laminated structure is omitted from the illustration for convenience only.

Moreover, as in the case of the above-described ink jet head 100*b* or 100*c*, the ink jet head 100*e* according to the fifth modification is made by the patterning method using dry film resists, and the wiring patterns 123*b*, together with discrete electrodes 109 and contact portions 121, are formed on the head main body 32 by means of the patterning, and the wiring patterns 123*b*, the discrete electrodes 109 and the contact portions 121 are integrally made from the same material on the same plane in the form of a thin film.

As FIGS. 23 and 24 show, these wiring patterns 123*b* are laid along the joint section 8*b* (8*c*) under the joint section 8*b* (8*c*), that is, between the head main body 32 and the joint section 8*b* (8*c*), and are separated from the joint section 8*b* (8*c*) at positions near the contact portions 121 to be connected to the contact portions 121.

Furthermore, as FIGS. 23 and 24 show, in the head main body 32, on the surface where the discrete electrodes 109 and others exist, the diaphragm 104 is exposed outside the joint section 8*b* (8*c*), that is, in the vicinity of corner portions of the head main body 32, thereby forming the contact portions 127.

Still furthermore, FPCs (external connection wiring members; not shown in FIGS. 23 to 25) are electrically connected to these contact portions 121 and 127 by a method such as TAB.

With the above-described construction, after the electrical connection of the FPCs to the contact portions 121 and 127 by the method such as the TAB, a drive circuit or the like, not shown, supplies a drive signal through the FPC to each of the discrete electrodes 109, so the pressurizer 140 pressurizes the pressure chamber 112 to make each of the nozzles 120 discharge the ink.

As described above, also with the ink jet head 100*e* constituting the fifth modification of the first embodiment of the present invention, at the electrical connection between each of the discrete electrodes 109 and each of the contact portions 121, each of the discrete electrodes 109 can be electrically connected to the FPC, which supplies a signal for the control of the pressurizers 140, without receiving the influence of the joint section 8*b* (8*c*), thus providing the effects similar to those of the above-described fourth modification of the ink jet head according to the first embodiment. In addition, since the wiring patterns 123*b* are laid between the joint section 8*b* (8*c*) and the head main body 32, the wiring patterns 123*b* can be protected without being exposed to the external, so, for example, the disconnection or the like of the wiring patterns 123*b* becomes preventable.

(G) Description of Second Embodiment

Figure 26:
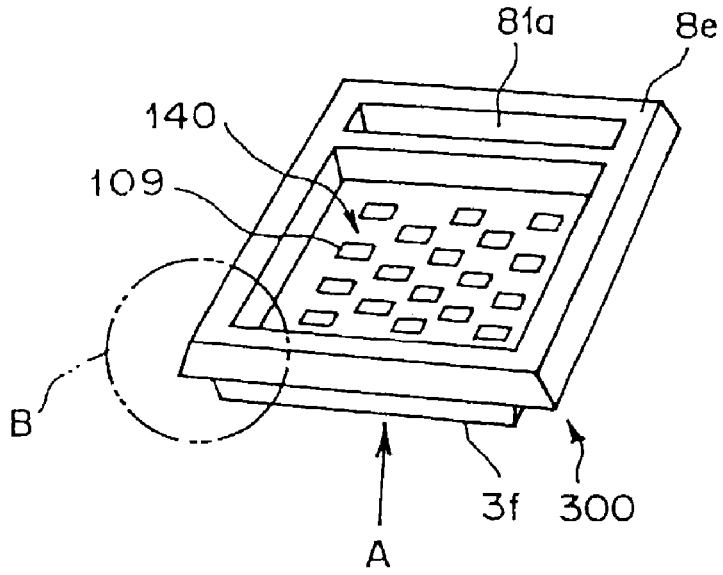
FIG. 26 is a perspective view showing a construction of a head main body of an ink jet head according to a second embodiment of the present invention.
Figure 27:
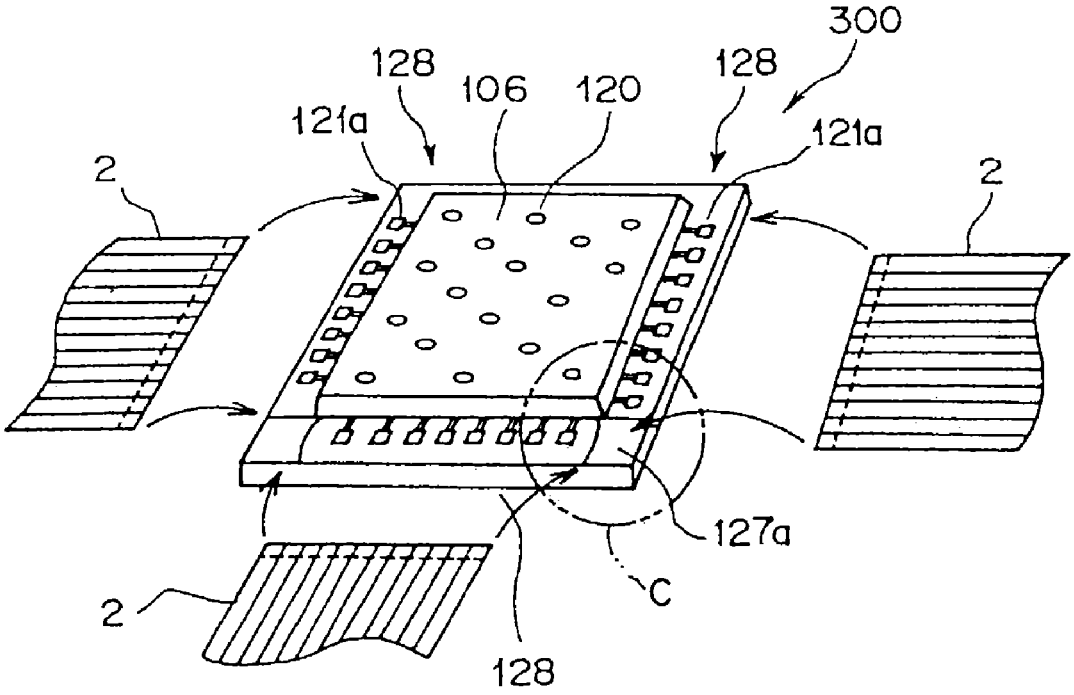
FIG. 27 is an illustration of a section indicated by an arrow A in FIG. 26.
Figure 28:
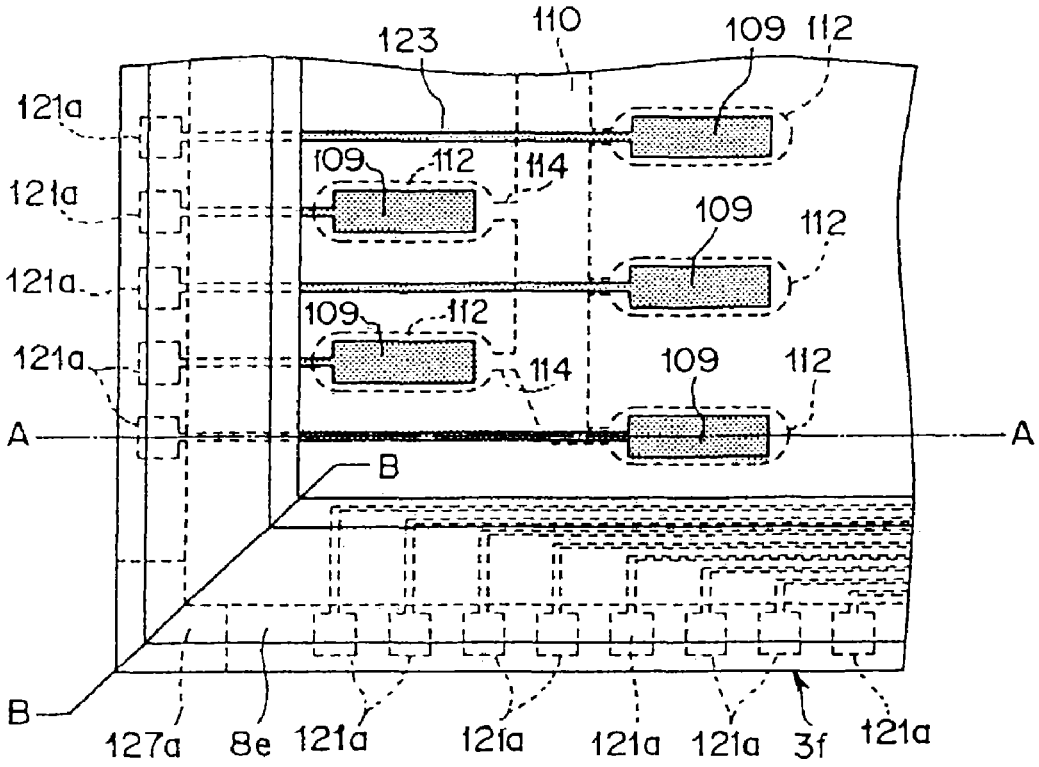
FIG. 28 is an enlarged plan view showing a portion B in FIG. 26.
Figure 29:
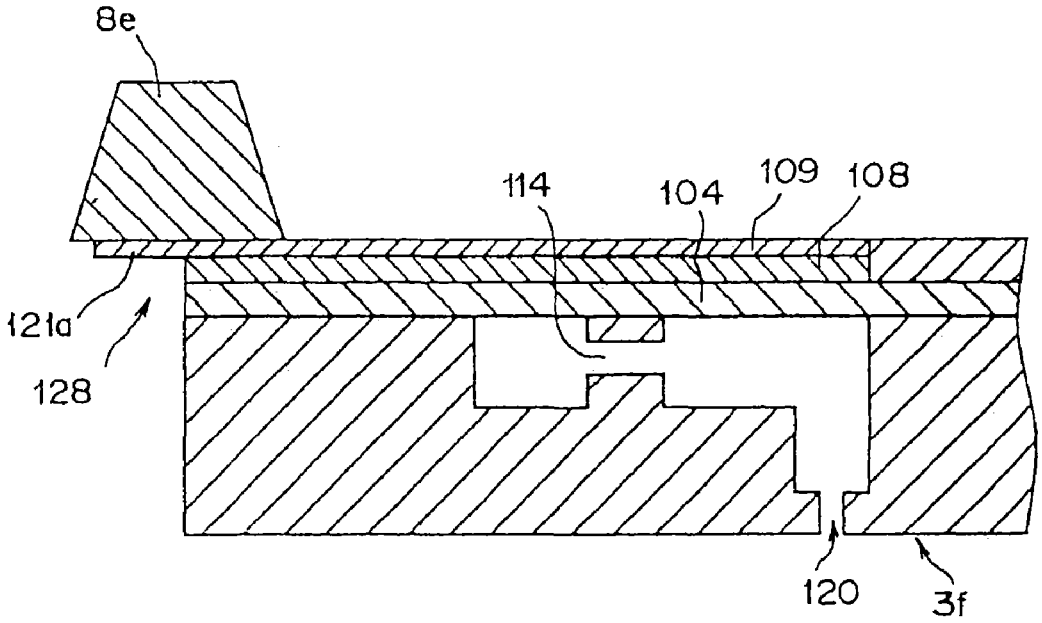
FIG. 29 is a cross-sectional view taken along a line A—A of FIG. 28.
Figure 30:
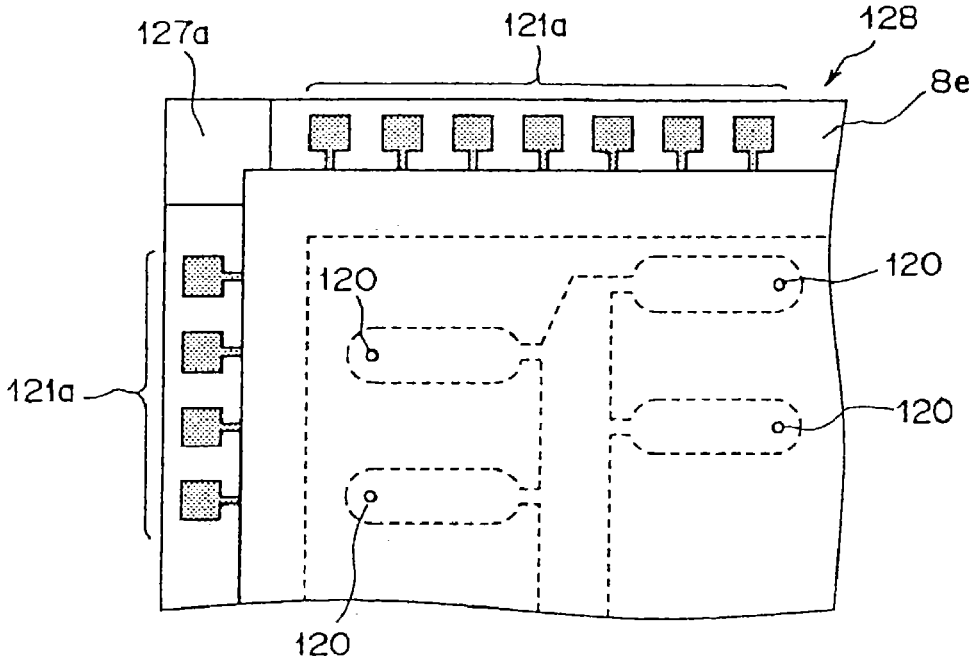
FIG. 30 is an enlarged plan view showing a portion C in FIG. 27.
Figure 31:
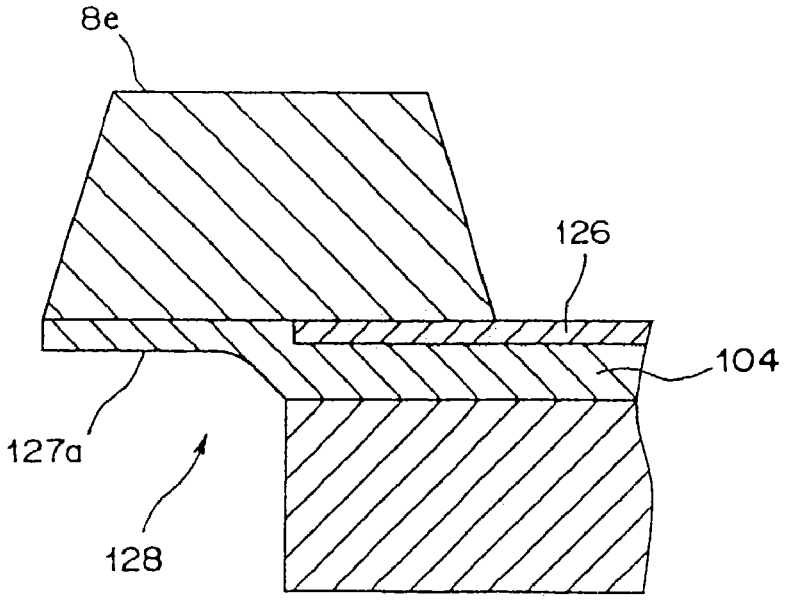
FIG. 31 is a cross-sectional view taken along a line B—B of FIG. 28.

FIGS. 26 to 31 are illustrations for explaining a construction of an ink jet head according to a second embodiment of the present invention. FIG. 26 is a perspective view showing a construction of a head main body of the ink jet head according to the second embodiment of the present invention, FIG. 27 is an illustration of a section indicated by an arrow A in FIG. 26, FIG. 28 is an enlarged plan view showing a portion B in FIG. 26, FIG. 29 is a cross-sectional view taken along a line A—A of FIG. 28, FIG. 30 is an enlarged plan view showing a portion C in FIG. 27, and FIG. 31 is a cross-sectional view taken along a line B—B of FIG. 28.

In the illustrations, the same reference numerals as those used above designate the same or nearly same parts, and the detailed description will be omitted.

In an ink jet head 300 according to the second embodiment of the present invention, a joint section 8*e* is provided in place of the joint section 8*a* of the ink jet head 100*a* shown in FIGS. 15 and 16, and contact portions 121*a* are formed on this joint section 8*e*. The construction thereof will be described with reference to FIGS. 26 to 31.

As FIG. 26 shows, as well as 100 in the above-described first embodiment, the ink jet head 300 according to the second embodiment has a plurality of nozzles 120 each for discharging ink supplied from an ink tank (ink supply section; not shown in FIGS. 26 to 31), and is made up of a head main body 3*f* and the joint section 8*e* as shown in FIGS. 26 to 31.

In addition, as well as the above-described ink jet head 100, the ink jet head 300 according to the second embodiment is also made by piling up a plurality of layers such as dry film resists 103*a* to 103*e*, stainless plates 105*a*, 105*b* and others, but in FIGS. 29 to 31, this laminated structure is omitted from the illustration for convenience only.

In the head main body 3*f*, each of the nozzles 120 includes a pressure chamber 112, a pressurizer 140 and an ink supply passage.

As FIGS. 26 to 31 show, the joint section 8*e* is formed to protrude from the surface of the head main body 3*f* (the discrete electrode 109 formation side of the head main body 3*f*) opposite to the formation of the nozzles 120, and is formed to surround discrete electrodes 109 on the surface of the formation of the discrete electrodes 109 in the head main body 3*f*, and further, this joint section 8*e* is protrusively formed to go beyond a circumferential edge or fringing of the head main body 3*f* and further to extend toward the external as shown in FIGS. 29 and 31.

Concretely, in the second embodiment, the joint section 8*e* is formed along the circumferential edge of the head main body 3*f* so that a nearly half portion thereof is protruded to the external in a state parallel with the circumferential edge of the head main body 3*f*.

As well as the above-mentioned joint section 8*a* of the ink jet head 100*a* shown in FIG. 15, the substrate made of magnesium oxide (MgO) is partially removed from the head main body 3*f* by means of photoetching, thereby forming the joint section 8*e* as a residual portion of the substrate on the head main body 3*f*. Moreover, the ink tank (ink supply part; not shown) is joined to the head main body 3*f* in a manner that the ink tank is adhered through an adhesive or the like to the joint section 8*e*.

In this connection, the joint section 8*e* of the ink jet head 300 according to the second embodiment also has a cross-sectional configuration, tapered to be narrower at the top as shown in FIG. 29, whereby an adhesive forced out from the adhesion surface to the ink tank is held by its slopes to prevent the forced-out adhesive from reaching the head main body 3*f* (pressurizers 140).

Furthermore, in this joint section 8*e*, contact portions 121*a* and 127*a* are formed on a portion protruding toward the external beyond the circumferential edge of the head main body 3*f* and a surface (upper side in FIG. 27; which will be referred to hereinafter as a contact portion formation surface 128) opposite to the ink tank joining side.

In this connection, in the second embodiment, the contact portions 127*a* are formed at the corner portions on the contact portion formation surface 128, and these contact portions 127*a* is formed unitarily with a diaphragm 104 as shown in FIG. 31.

In addition, a plurality of contact portions 121*a* are formed between the contact portions 127*a* on the contact portion formation surface 128. Each of the contact portions 121*a* exists for each of the discrete electrodes 109.

Incidentally, the locations of these contact portions 121*a* and 127*a* are not limited to these, but all changes and modifications which do not constitute departures from the spirit and scope of the invention are acceptable.

Still additionally, these contact portion 121*a* and discrete electrode 109 are electrically connected to each other through a wiring pattern 123 made in the form of a thin film.

That is, in the second embodiment, the contact portions 121*a* are located outside the circumferential edge of the head main body 3*f* on the joint section 8*e* side and the contact portions 121*a* each for each of the discrete electrodes 109 are placed on the contact portion formation surface 128 of the joint section 8*e*, and as shown in FIG. 27, FPCs 2 for supplying signals to control the pressurizers 140 are electrically connected to these contact portions 121*a* through the use of a method such as TAB.

With the above-mentioned construction, after the electrical connection of the FPCs to the contact portions 121*a* and 127*a* by the method such as the TAB as shown in FIG. 27, a drive circuit or the like, not shown, supplies a drive signal through the FPC to each of the discrete electrodes 109, so the pressurizer 140 pressurizes the pressure chamber 112 to make each of the nozzles 120 discharge the ink.

As described above, also in the ink jet head 300 according to the second embodiment of the present invention, for the electrical connection between each of the discrete electrodes 109 and each of the contact portions 121*a*, the electrical connection between the FPC, for supplying signals to control the pressurizers 140, and each of the discrete electrodes 109 can be made without receiving the influence of the joint section 8*e*, thus providing the effects similar to those of the aforesaid ink jet head 100*a* constituting the first modification of the first embodiment. In addition, since the head main body 3*f* in which the nozzles 120 are made can be formed to be smaller than the joint section 8*e*, the size reduction of the ink jet head 300 becomes feasible.

Moreover, in the connection of the FPCs 2 to the contact portions 121*a* and 127*a*, the contact portions 121*a* and the contact portions 127*a* become equal in height to each other on the contact portion formation surface 128, thus providing surer electrical connection of the FPCs 2.

Still moreover, when the FPCs 2 are connected to the contact portions 121*a* and 127*a* under pressure, since the contact portion formation surface 128 is pressurized from the upper surfaces of the FPCs 2, the joint section 8*e* having a high rigidity supports the contact portion formation surface 128, which results in improving the manufacturing stability.

(H) Description of Third Embodiment

Figure 32:
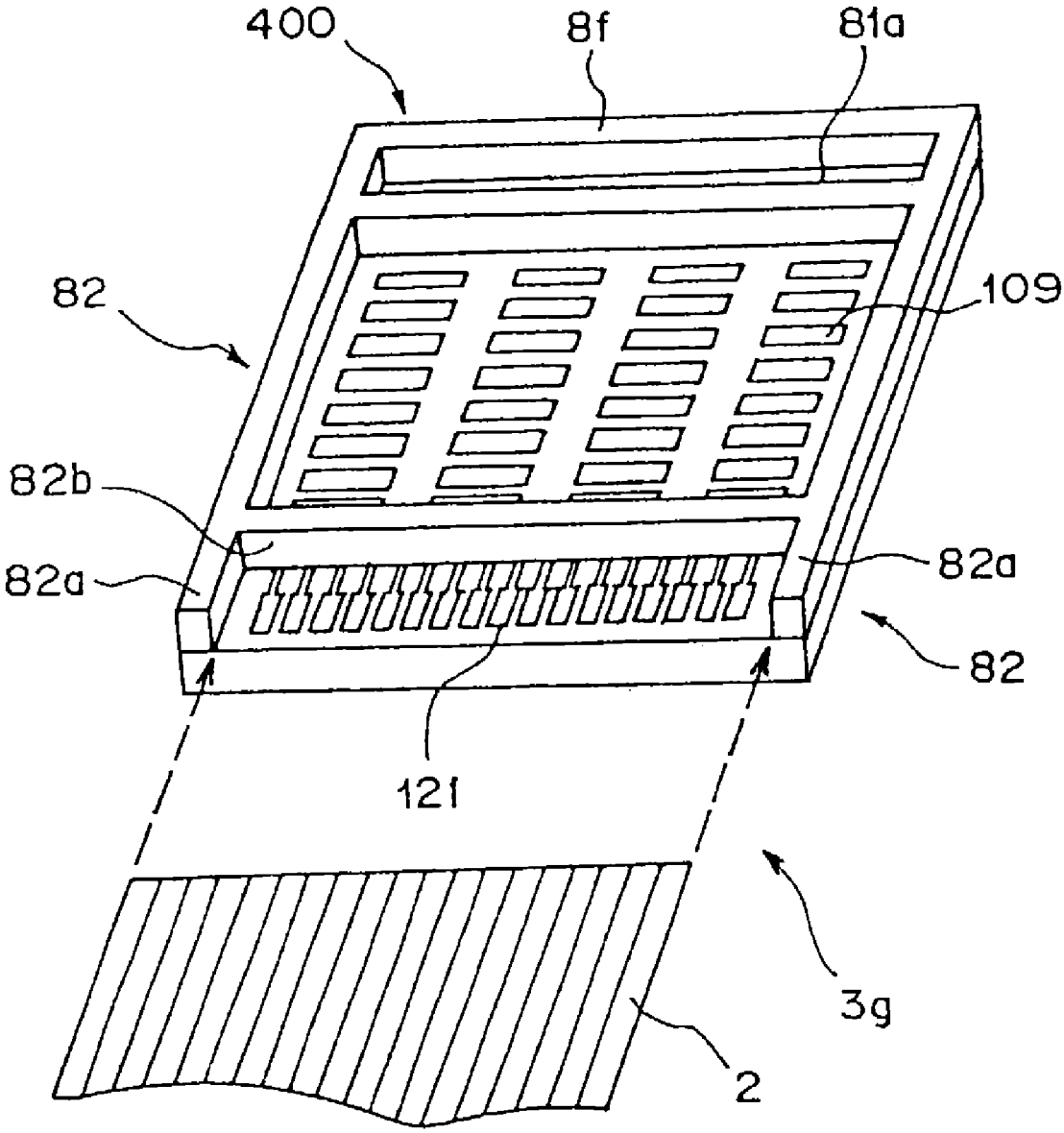
FIG. 32 is a perspective view showing a construction of a head main body of an ink jet head according to a third embodiment of the present invention.

FIG. 32 is a perspective view showing a construction of a head main body of an ink jet head according to a third embodiment of the present invention. As well as the above-described ink jet head 100*a* according to the first modification, as FIG. 32 shows, an ink jet head 400 according to the third embodiment of the present invention also has a plurality of nozzles (not shown) each for discharging ink supplied from an ink tank (ink supply section; not shown), and is composed of a head main body 3*g* and a joint section 8*f*.

Incidentally, in the illustration, the same reference numerals as those used above designate the same or almost same portions, and the detailed description thereof will be omitted.

The joint section 8*f* is protrusively formed on a surface (upper side in FIG. 32) of the head main body 3*g* opposite to the nozzle formation side, and is made to surround discrete electrodes 109 on the surface of the head main body 3*g* where the discrete electrodes 109, contact portions 121 and wiring patterns 123 exist.

For the formation of this joint section 8*f*, the substrate made of magnesium oxide (MgO) is partially removed from the head main body 3*g* by means of photoetching, thereby forming it as a residual portion of the substrate on the head main body 3*g*. Moreover, the ink tank (ink supply part) or an ink tank fixing member is adhered through an adhesive or the like to the joint section 8*f* for joining the ink tank 50 to the head main body 3*g*.

In addition, the joint section 8*f* has a cross-sectional configuration, tapered to be narrower at the top, whereby an adhesive forced out from an adhering surface to the ink tank 50 is held by its slopes to prevent the forced-out adhesive from reaching the head main body 3*g*.

Still additionally, in the joint section 8*f*, of the members constituting the joint section 8*f*, a pair of members are protruded in the same direction in a state parallel with each other, there by forming a positioning portion 82. The pair of members protruding from the joint section 8*f* for the formation of this positioning portion 82 will be referred to hereinafter as protruding portions, and will be designated at reference numeral 82*a*.

The positioning portion 82 is made up of the protruding portions 82*a* and an outer circumferential surface 82*b* on which the protruding portion 82 of the joint section 8*f* is formed.

Moreover, a plurality of contact portions 121 and 127 are formed on the surface of the head main body 3*g*, where the discrete electrodes 109, the wiring patterns 123 and others exist, and between the pair of protruding portions 82*a* outside the joint section 8*f*.

With this construction, an end surface of an FPC (external connection wiring member) 2 is brought into contact with the outer circumferential surface 82*b* between the pair of protruding portions 82*a* for positioning the FPC 2 with respect to the contact portions 121, and the FPC 2 is then electrically connected to the contact portions 121 and 127 through the use of the TAB method.

As described above, in the ink jet head 400 according to the third embodiment of the present invention, since the positioning of the FPC 2 with respect to the contact portions 121 can be made by bringing the end surface of the FPC 2 into contact with the outer circumferential surface 82*b* between the pair of protruding portions 82*a*, it is possible to certainly accomplish the electrical connection between the FPC 2 and the contact portions 121 and 127, and further to eliminate the need for a part dedicated to the positioning of the FPC 2, thus reducing the number of parts for the construction of the ink jet head 400.

(I) Description of Fourth Embodiment

Figure 33:
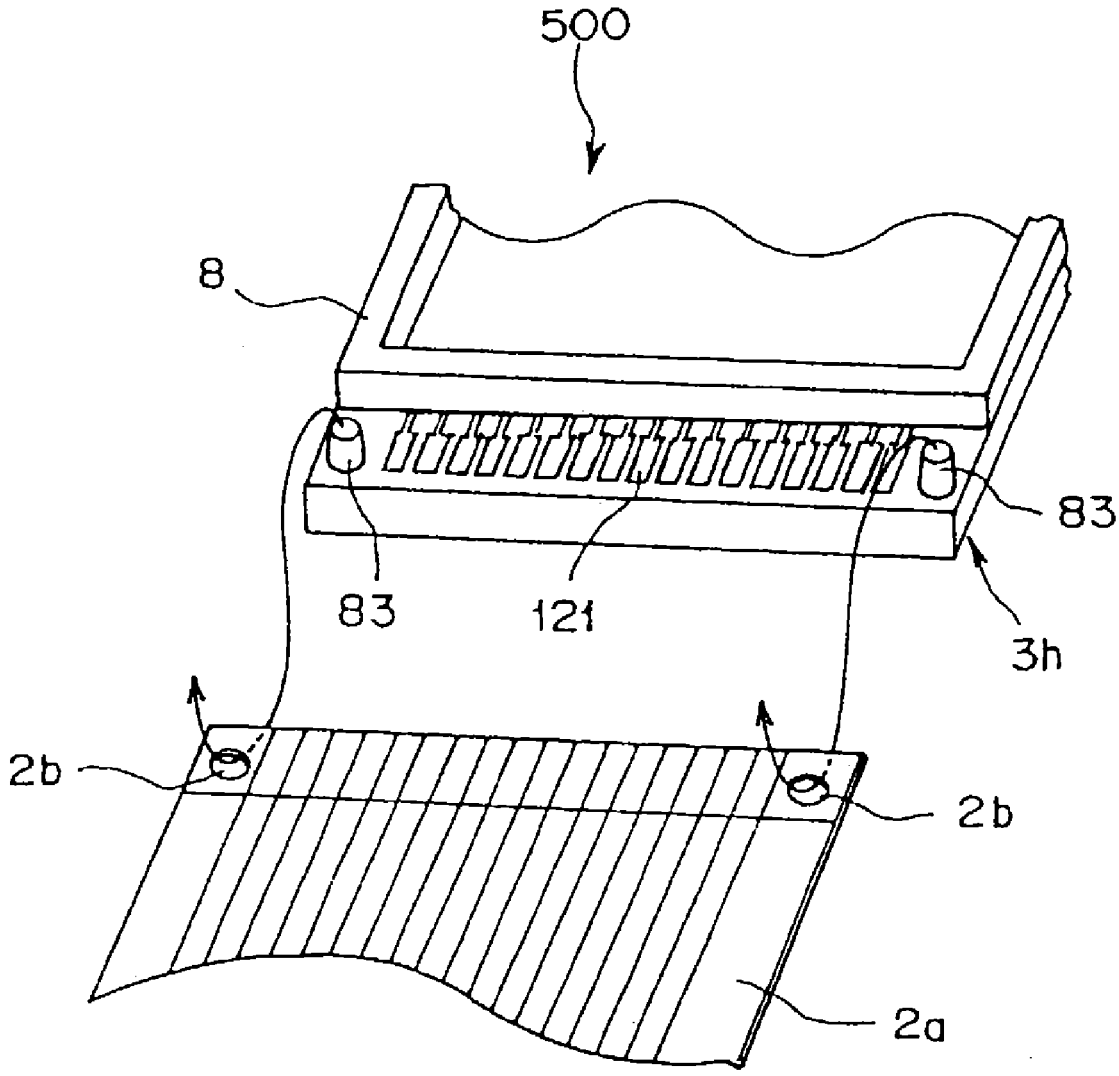
FIG. 33 is a perspective view showing a construction of an essential part of an ink jet head according to a fourth embodiment of the present invention.
Figure 34:
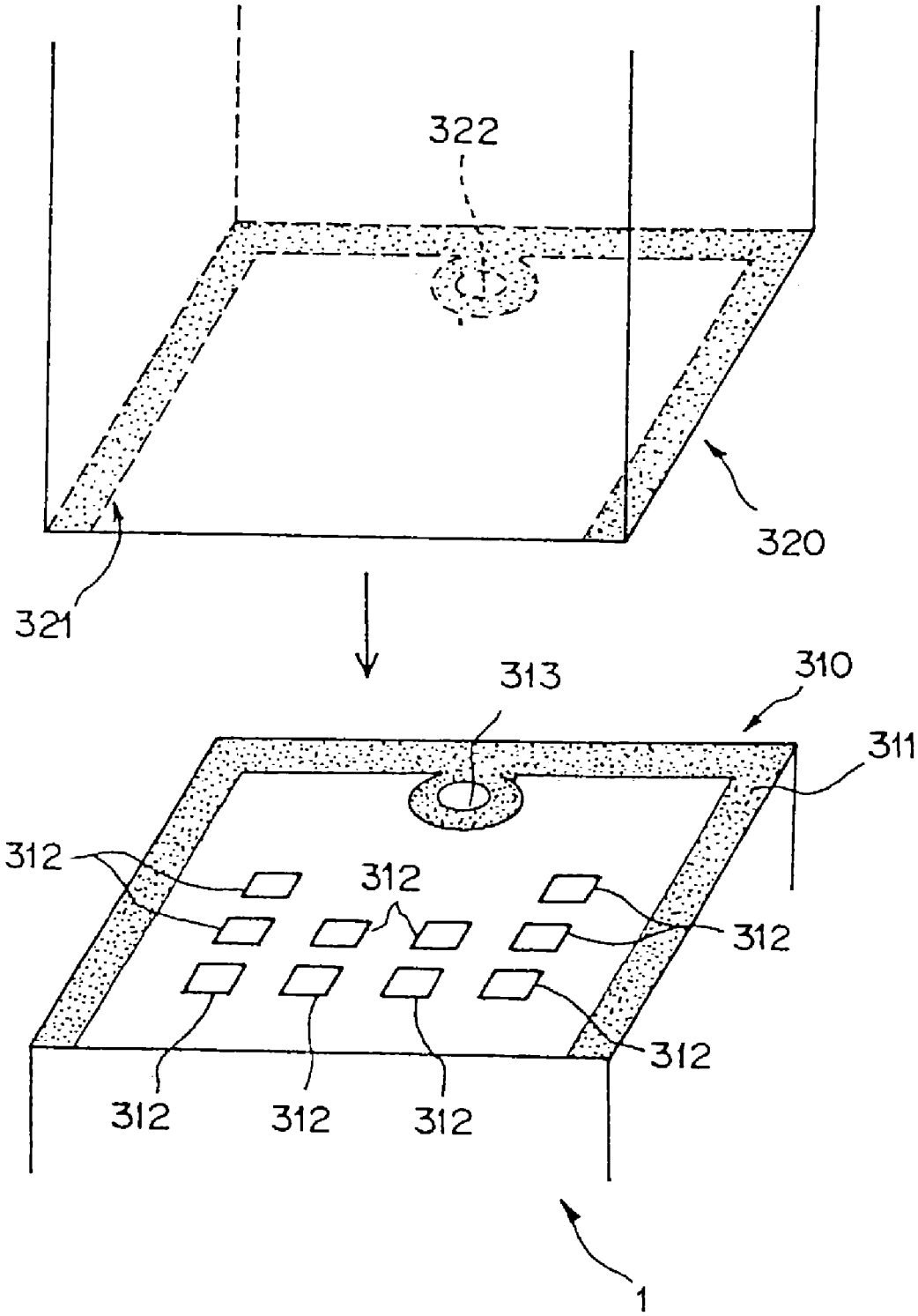
FIG. 34 is an exploded view showing a construction of an essential part of a conventional ink jet head.

FIG. 33 is a perspective view showing a construction of an essential part of an ink jet head according to a fourth embodiment of the present invention. As well as the above-described ink jet head 400 according to the fourth embodiment, an ink jet head 500 according to this fourth embodiment has a plurality of nozzles (not shown) each for discharging ink supplied from an ink tank (ink supply section; not shown), and is composed of a head main body 3*h* and a joint section 8 as shown in FIG. 33.

Incidentally, in the illustration, the same reference numerals as those used above designate the same or nearly same portions, and the detailed description thereof will be omitted.

As FIG. 33 shows, the ink jet head 500 according to this fourth embodiment provides the joint section 8 in place of the joint section 8*f* in the ink jet head 400 shown in FIG. 32, and positioning portions 83 are provided therein.

A pair of nearly column-like positioning portions 83 are made at corner portions of at least one of the edges constituting the circumferential edge of the head main body 3*h*, outside the joint section 8 and on the surface where discrete electrodes 109, wiring patterns 123 and others are formed, and a plurality of contact portions 121 and 127 are made between the pair of positioning portions 83.

In addition, alignment holes 2*b* each substantially equal in cross-sectional configuration to each of the positioning portions 83 are made in the vicinity of an end portion of an FPC 2*a* and at positions corresponding to the aforesaid pair of positioning portions 83.

With this construction, each of the positioning portions 83 is inserted into each of the alignment holes 2*b* made in the FPC (external connection wiring member) 2*a* for positioning the FPC 2*a* with respect to the contact portions 121 and 127, then the FPC 2*a* is electrically connected to the contact portions 121 and 127 through the use of the TAB method.

As described above, with the ink jet head 500 according to the fourth embodiment of the present invention, when the positioning portions 83 are fitted into the alignment holes 2*b* made in the FPC 2*a*, the positioning of the FPC 2*a* can be made with respect to the contact portions 121 and 127, thereby surely accomplishing the electrical connection between the FPC 2 and the contact portions 121 and 127.

(J) Others

It should be understood that the present invention is not limited to the above-described embodiments, and that it is intended to cover all changes of the embodiments of the invention herein which do not constitute departures from the spirit and scope of the invention.

For example, the above-described ink jet head 100 according to the first embodiment is made by joining three layers of (A) to (C) layers, but the invention is not limited to this, and it can be made with an arbitrary number of layers, for example, two layers.

In addition, although in the above-described first embodiment the (B) layer is formed using three layers (excluding the adhesive layer) and the (C) layer is formed using five layers and further the stainless plate 105 is placed thereon, the invention is not limited to this, but it is also possible to construct the (B) layer or the (C) layer using a desired number of layers, and further, it is also acceptable that each of the layers has a desired thickness.

Still additionally, although in the above-described first embodiment the stainless plate 105*a* is joined onto the dry film resist 103*c*, the invention is not limited to this, but it can also be formed on the dry film resist 103*d* in the (B) layer.

Yet additionally, in place of the stainless plate 105*a*, a member can also be provided which is made of a material except metals or ceramics, for example, a resin such as PEN or a compound resin such as FRP. Incidentally, in the case of constructions using these members, since they have a coefficient of thermal expansion close to that of the other dry film resist 103, it is possible to reduce the thermal remanent stress in the heating treatment such as joining, thus resulting in the improvement of the quality of the ink jet head.

Moreover, although each of the contact portions 121 and 127 and the FPC 2 (2*a*) are connected to each other according to the TAB method, the invention is not limited to this, but various changes are also acceptable.

Still moreover, in the ink jet heads 100 (100*d*, 100*e*, 400, 500) according to the fourth and fifth modifications of the first embodiment, the second embodiment, the third embodiment and the fourth embodiment, limitations are not imposed on the configurations of the joint sections 8 (8*b*, 8*c*, 8*e*, 8*f*) or the configurations of the common ink passages 110 (110*b*), but various changes are also acceptable.

Yet moreover, in the first and second modifications of the first embodiment, the second embodiment and the third embodiment, limitations are not imposed on the configurations of the wiring patterns 123, but it is also possible to use the configurations of the wiring patterns 123 in the fourth or fifth modification of the ink jet according to the first embodiment.

Incidentally, the persons skilled in the art can manufacture them on the basis of the disclosure of each of the embodiments of the present invention.

INDUSTRIAL APPLICABILITY

As described above, with the ink jet heads, ink jet head manufacturing methods and printers according to the present invention, the adhesion allowance needed in joining an ink supply part is reducible, so the degree of integration of a head main body is incresable for the size reduction thereof, and the rigidity of the head main body is improvable. Therefore, the head main body is applicable to an ink jet head of an ink jet incorporated printer.

What is claimed is:

1. A method of manufacturing an ink jet head having a plurality of nozzles (120) for discharging ink supplied from an ink supply part (50), characterized in that comprising:

a step of forming, on a substrate (122), a head main body (3) including a plurality of pressure chambers (112) provided one for each of said nozzles (120) and filled up with ink, a plurality of pressurizers (140) provided one for each of said pressure chambers (112) for pressurizing said pressure chamber (112) to discharge said ink in said pressure chamber (112) from said nozzle (120) and a common ink passage (110) for supplying said ink from said ink supply part (50) to said plurality of pressure chambers (112); and a step of removing said substrate (122) partially from said head main body (3) to form, in said substrate (122), a communicating passage (81) for making a communication between said common ink passage (110) and an ink supply port (51) of said ink supply part (50) and of forming a residual portion of said substrate (122) on said head main body (3) as a joint portion for joining said ink supply part (50) to said head main body (3).

2. A method of manufacturing an ink jet head according to claim 1, characterized in that said substrate (122) is made of magnesium oxide.

3. A method of manufacturing an ink jet head according to claim 2, characterized in that said substrate 122 is partially removed by means of a photoetching treatment.

* * * * *